US009291942B2

(12) United States Patent
Matsuzaki et al.

(10) Patent No.: US 9,291,942 B2
(45) Date of Patent: Mar. 22, 2016

(54) DEVELOPER ACCOMMODATING UNIT, PROCESS CARTRIDGE AND IMAGE FORMING APPARATUS

(71) Applicant: CANON KABUSHIKI KAISHA, Tokyo (JP)

(72) Inventors: Hiroomi Matsuzaki, Mishima (JP); Kojiro Yasui, Numazu (JP); Koji Yamaguchi, Numazu (JP); Masaaki Matsushita, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/151,986

(22) Filed: Jan. 10, 2014

(65) Prior Publication Data

US 2014/0199094 A1 Jul. 17, 2014

(30) Foreign Application Priority Data

Jan. 11, 2013 (JP) ..... 2013-003263

(51) Int. Cl.
*G03G 15/08* (2006.01)
*G03G 21/16* (2006.01)

(52) U.S. Cl.
CPC ..... *G03G 15/0882* (2013.01); *G03G 15/0841* (2013.01); *G03G 15/0898* (2013.01); *G03G 21/1676* (2013.01); *G03G 2215/0682* (2013.01); *G03G 2215/0687* (2013.01); *G03G 2215/0875* (2013.01)

(58) Field of Classification Search
CPC ..... G03G 15/0841; G03G 15/0874; G03G 21/1676; G03G 2215/0682; G03G 2215/0687; G03G 2215/0875; G03G 15/0882
USPC ..... 399/103, 106, 119, 120, 258
See application file for complete search history.

(56) References Cited

U.S. PATENT DOCUMENTS

| | | | | |
|---|---|---|---|---|
| 5,030,998 | A * | 7/1991 | Shibata et al. | 399/106 |
| 5,264,901 | A * | 11/1993 | Rossiter | 399/105 |
| 5,943,529 | A | 8/1999 | Miyabe et al. | |
| 5,966,567 | A | 10/1999 | Matsuzaki et al. | |
| 6,011,941 | A | 1/2000 | Takashima et al. | |
| 6,097,906 | A | 8/2000 | Matsuzaki et al. | |
| 6,144,815 | A | 11/2000 | Chadani et al. | |
| 6,173,140 | B1 | 1/2001 | Suzuki et al. | |
| 6,173,145 | B1 | 1/2001 | Chadani et al. | |
| 6,205,305 | B1 | 3/2001 | Suzuki et al. | |
| 6,219,504 | B1 | 4/2001 | Matsuzaki et al. | |
| 6,282,389 | B1 | 8/2001 | Matsuzaki et al. | |

(Continued)

FOREIGN PATENT DOCUMENTS

| | | | |
|---|---|---|---|
| JP | 03221981 A | * | 9/1991 |
| JP | H 5-197288 | | 8/1993 |

*Primary Examiner* — Ryan Walsh
(74) *Attorney, Agent, or Firm* — Fitzpatrick, Cella, Harper & Scinto

(57) ABSTRACT

A developer accommodating container includes: a flexible container provided with an opening for permitting discharge of a developer; a sealing member, mounted to the flexible container in a state in which the sealing member seals the opening, capable of exposing the opening by being wound up; an unsealing member for winding up the sealing member by being rotated to expose the opening; a frame for accommodating the unsealing member; and a limiting portion for limiting deformation of the unsealing member with respect to a direction of a force applied from the sealing member to the unsealing member when the unsealing member winds up the sealing member.

18 Claims, 20 Drawing Sheets

(56) References Cited

U.S. PATENT DOCUMENTS

| | | | |
|---|---|---|---|
| 6,405,004 | B2 | 6/2002 | Matsuzaki et al. |
| 6,549,736 | B2 | 4/2003 | Miyabe et al. |
| 6,681,088 | B2 | 1/2004 | Kanno et al. |
| 6,782,219 | B2 | 8/2004 | Yoshino et al. |
| 6,792,229 | B2 | 9/2004 | Matsuzaki |
| 6,795,666 | B2 | 9/2004 | Miyabe et al. |
| 6,834,173 | B2 | 12/2004 | Yamaguchi et al. |
| 6,859,629 | B2 | 2/2005 | Miura et al. |
| 6,915,092 | B2 | 7/2005 | Yamaguchi et al. |
| 6,931,226 | B2 | 8/2005 | Chadani et al. |
| 6,934,485 | B2 | 8/2005 | Miyabe et al. |
| 6,947,687 | B2 | 9/2005 | Yamaguchi et al. |
| 6,961,528 | B2 | 11/2005 | Yamaguchi et al. |
| 6,978,100 | B2 | 12/2005 | Yasui et al. |
| 6,983,115 | B2 | 1/2006 | Isobe et al. |
| 7,016,626 | B2 | 3/2006 | Yokomori et al. |
| 7,068,965 | B2 | 6/2006 | Yoshino et al. |
| 7,085,516 | B2 | 8/2006 | Kawai et al. |
| 7,116,925 | B2 | 10/2006 | Yamaguchi |
| 7,136,604 | B2 | 11/2006 | Chadani et al. |
| 7,155,137 | B2 | 12/2006 | Yasui et al. |
| 7,184,687 | B2 | 2/2007 | Yamaguchi et al. |
| 7,194,225 | B2 | 3/2007 | Yamaguchi |
| 7,224,925 | B2 | 5/2007 | Sato et al. |
| 7,319,834 | B2 | 1/2008 | Yamaguchi |
| 7,349,657 | B2 | 3/2008 | Sato et al. |
| 7,412,193 | B2 | 8/2008 | Sato et al. |
| 7,477,865 | B2 | 1/2009 | Yamaguchi |
| 7,519,310 | B2 | 4/2009 | Yamaguchi et al. |
| 7,792,460 | B2 | 9/2010 | Yamaguchi et al. |
| 8,121,519 | B2 | 2/2012 | Yamaguchi et al. |
| 8,577,252 | B2 | 11/2013 | Anan et al. |
| 2011/0170906 | A1 | 7/2011 | Matsushita et al. |
| 2012/0027457 | A1 | 2/2012 | Yamaguchi et al. |
| 2013/0136489 | A1 | 5/2013 | Yamaguchi et al. |
| 2013/0164039 | A1 | 6/2013 | Matsushita et al. |
| 2013/0164040 | A1 | 6/2013 | Matsushita et al. |
| 2013/0336679 | A1 | 12/2013 | Furutani et al. |
| 2013/0343785 | A1 | 12/2013 | Matsuzaki et al. |
| 2014/0016961 | A1 | 1/2014 | Yasui et al. |
| 2014/0029974 | A1 | 1/2014 | Uesugi et al. |
| 2014/0064793 | A1 | 3/2014 | Matsuzaki et al. |
| 2014/0072329 | A1 | 3/2014 | Uesugi et al. |
| 2014/0072330 | A1 | 3/2014 | Yoshida et al. |
| 2014/0072331 | A1 | 3/2014 | Matsushita et al. |
| 2014/0072346 | A1 | 3/2014 | Furutani et al. |
| 2014/0079432 | A1 | 3/2014 | Matsuzaki et al. |
| 2014/0126928 | A1 | 5/2014 | Batori et al. |
| 2014/0199092 | A1 | 7/2014 | Matsushita et al. |
| 2014/0199093 | A1 | 7/2014 | Yoshida et al. |
| 2014/0199096 | A1 | 7/2014 | Yoshida et al. |

* cited by examiner (a)

(b)

(a)

(b)

(a)

(b)

(a)

(b)

(c)

DEVELOPER ACCOMMODATING UNIT, PROCESS CARTRIDGE AND IMAGE FORMING APPARATUS

FIELD OF THE INVENTION AND RELATED ART

The present invention relates to an image forming apparatus, and a developer accommodating unit and a process cartridge which are used in the image forming apparatus.

The image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine, and the like.

The cartridge refers to a cartridge, prepared by integrally assembling a developing means and a developing device accommodating a developer into a unit, detachably mountable to an image forming apparatus main assembly, or refers to a cartridge, prepared by integrally assembling the developing device and a photosensitive (member) unit including a photosensitive member into a unit, detachably mountable to the image forming apparatus main assembly.

The developer accommodating unit is accommodated in the image forming apparatus or the cartridge, and includes a flexible container for accommodating the developer.

In a conventional electrophotographic image forming apparatus using the electrophotographic process, a process cartridge type in which an electrophotographic photosensitive member and a process means actable n the photosensitive member are integrally assembled into a cartridge so as to be detachably mountable to a main assembly of the electrophotographic image forming apparatus is employed.

FIG. 21 is a sectional view showing a structure of a conventional process cartridge.

As shown in the figure, the process cartridge includes a photosensitive drum 111 and a developing roller 13.

Further, in the process cartridge, an opening 135 provided at an accommodating portion for accommodating the developer is sealed with a toner seal 139 provided on a developer stirring member 137. Then, during use, the developer stirring member 137 is rotated to peel off the toner seal 139 to unseal the opening 135 thereby to supply the developer. Such a constitution is disclosed in Japanese Laid-Open Patent Application (JP-A) Hei 5-197288.

In such a conventional process cartridge, the toner seal material is wound up by the developer stirring member. However, in the case where peeling strength for peeling off a bonding portion between the toner seal material and the accommodating portion 138 is large or in the case of a large-sized process cartridge, the developer stirring member is deformed and thus it becomes difficult to peel off the toner seal material to unseal the opening in some cases.

Further, in the case where a flexible container is used as a developer accommodating portion, also a factor of deformation of the flexible container is added, so that it becomes further difficult to peel off the sealing member such as the toner seal material to unseal the opening in some cases.

SUMMARY OF THE INVENTION

A principal object of the present invention is to provide a developer accommodating unit, a process cartridge and an image forming apparatus which are capable of peeling off a sealing member with reliability even in the case where peeling strength for peeling off a bonding portion between the sealing member and an accommodating portion thereby to stably supply a developer.

According to an aspect of the present invention, there is provided a developer accommodating container comprising: a flexible container provided with an opening for permitting discharge of a developer; a sealing member, mounted to the flexible container in a state in which the sealing member seals the opening, capable of exposing the opening by being wound up; an unsealing member for winding up the sealing member by being rotated to expose the opening; a frame for accommodating the unsealing member; and a limiting portion for limiting deformation of the unsealing member with respect to a direction of a force applied from the sealing member to the unsealing member when the unsealing member winds up the sealing member.

These and other objects, features and advantages of the present invention will become more apparent upon a consideration of the following description of the preferred embodiments of the present invention taken in conjunction with the accompanying drawings.

Figure 7:
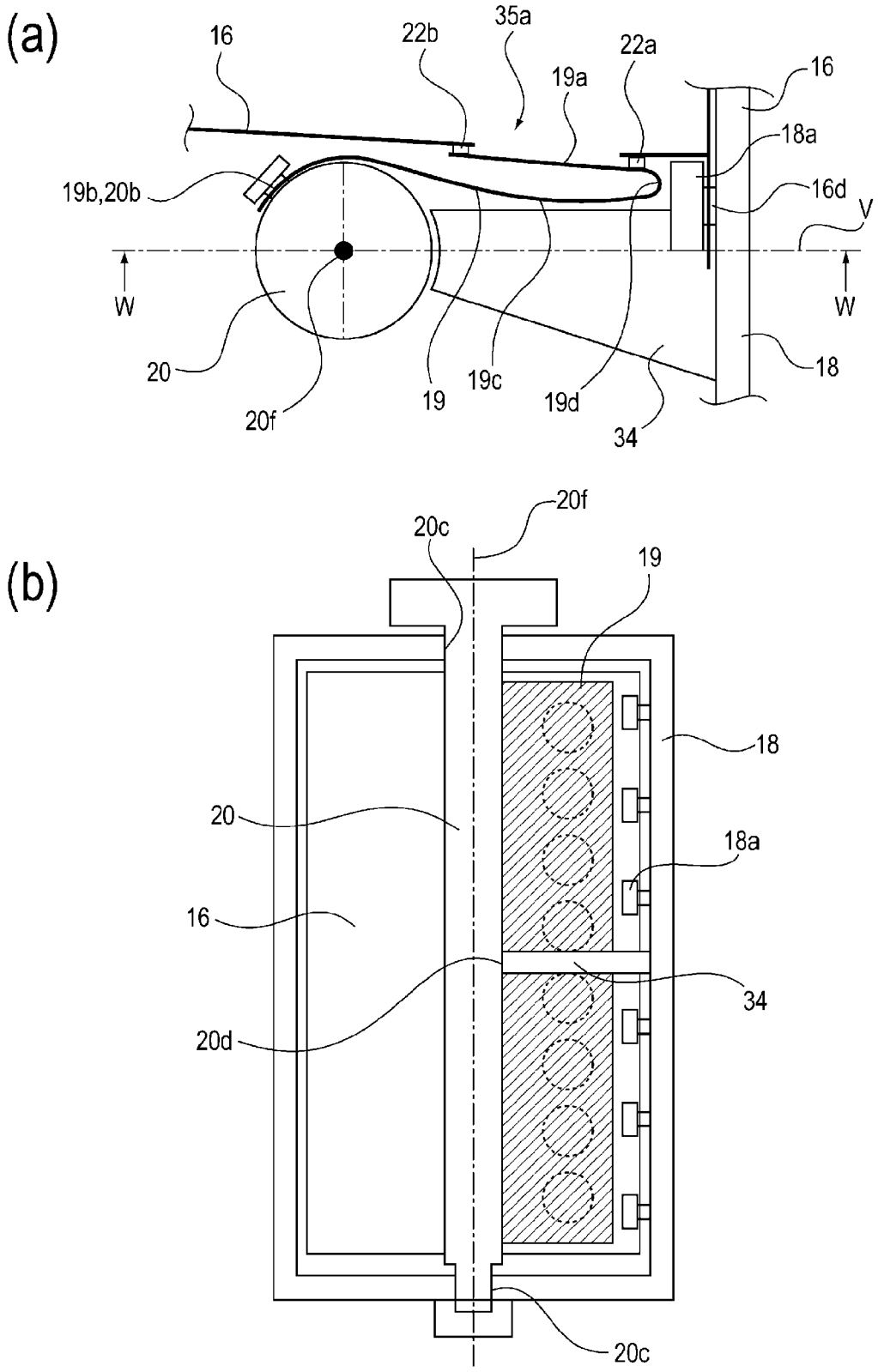

Parts (a) and (b) of FIG. 7 are sectional views showing a cross section of a peripheral portion of an opening of the developer accommodating container before the unsealing in First Embodiment in which (a) of FIG. 7 is the sectional view with respect to a direction perpendicular to a rotation shaft of the unsealing member, and (b) of FIG. 7 shows the cross section including a plane containing the rotation shaft of the unsealing member.

Figure 8:
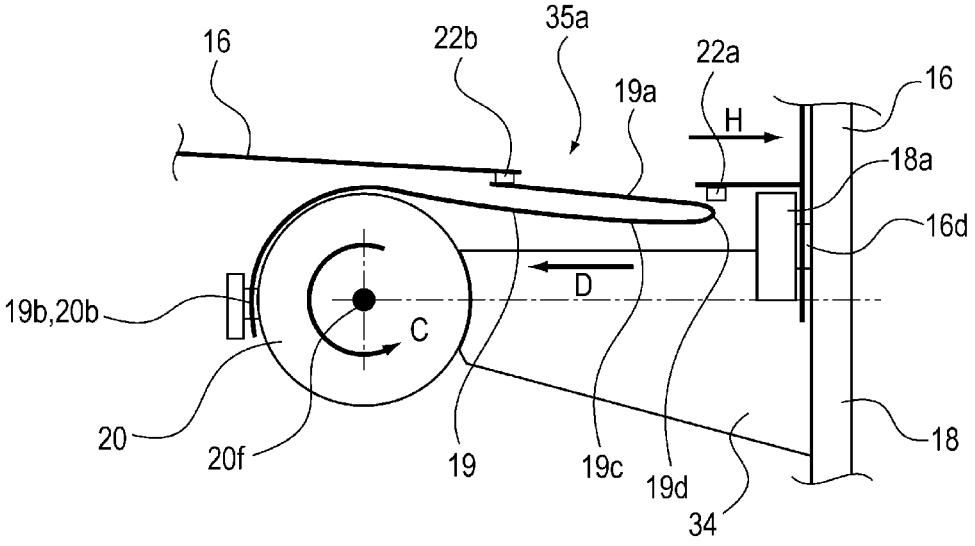
Figure 8:
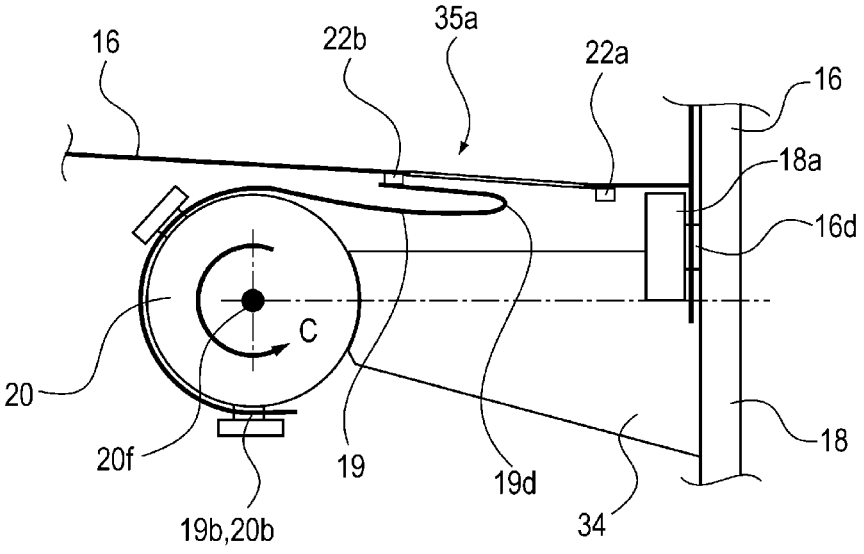

Parts (a) and (b) of FIG. 8 are sectional views showing a process in which the sealing member is unsealed by peeling of a first bonding portion by the unsealing member in First Embodiment, in which (a) of FIG. 8 shows a stage of start of the peeling of the first bonding portion, and (b) of FIG. 8 shows a stage of completion of the peeling of the first bonding portion.

Figure 9:
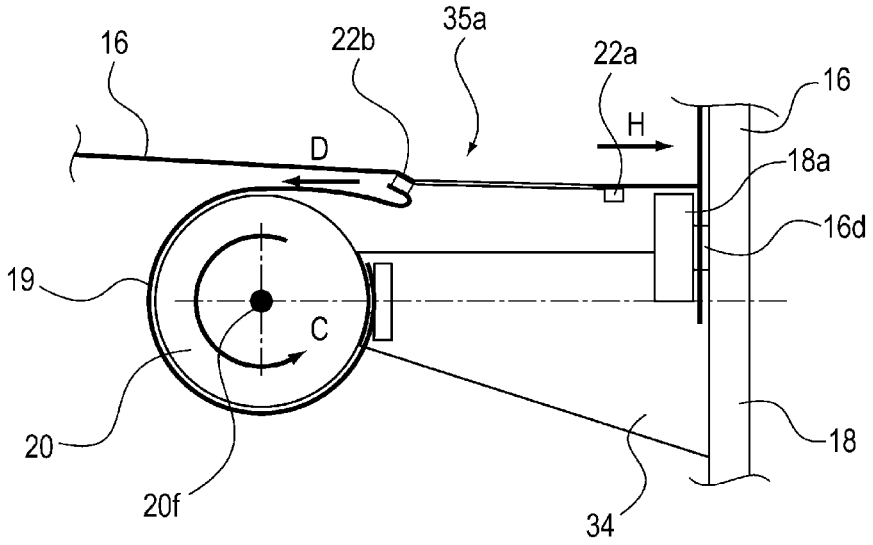
Figure 9:
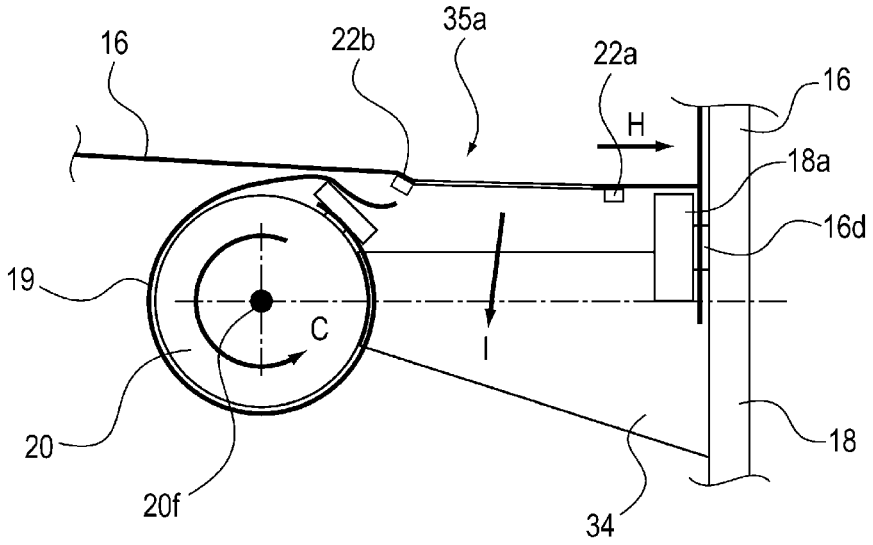

Parts (a) and (b) of FIG. 9 are sectional views showing a process in which the sealing member is unsealed by peeling of a second bonding portion by the unsealing member in First Embodiment, in which (a) of FIG. 9 shows a stage of start of the peeling of the second bonding portion, and (b) of FIG. 9 shows a stage of completion of the peeling of the second bonding portion.

Figure 10:
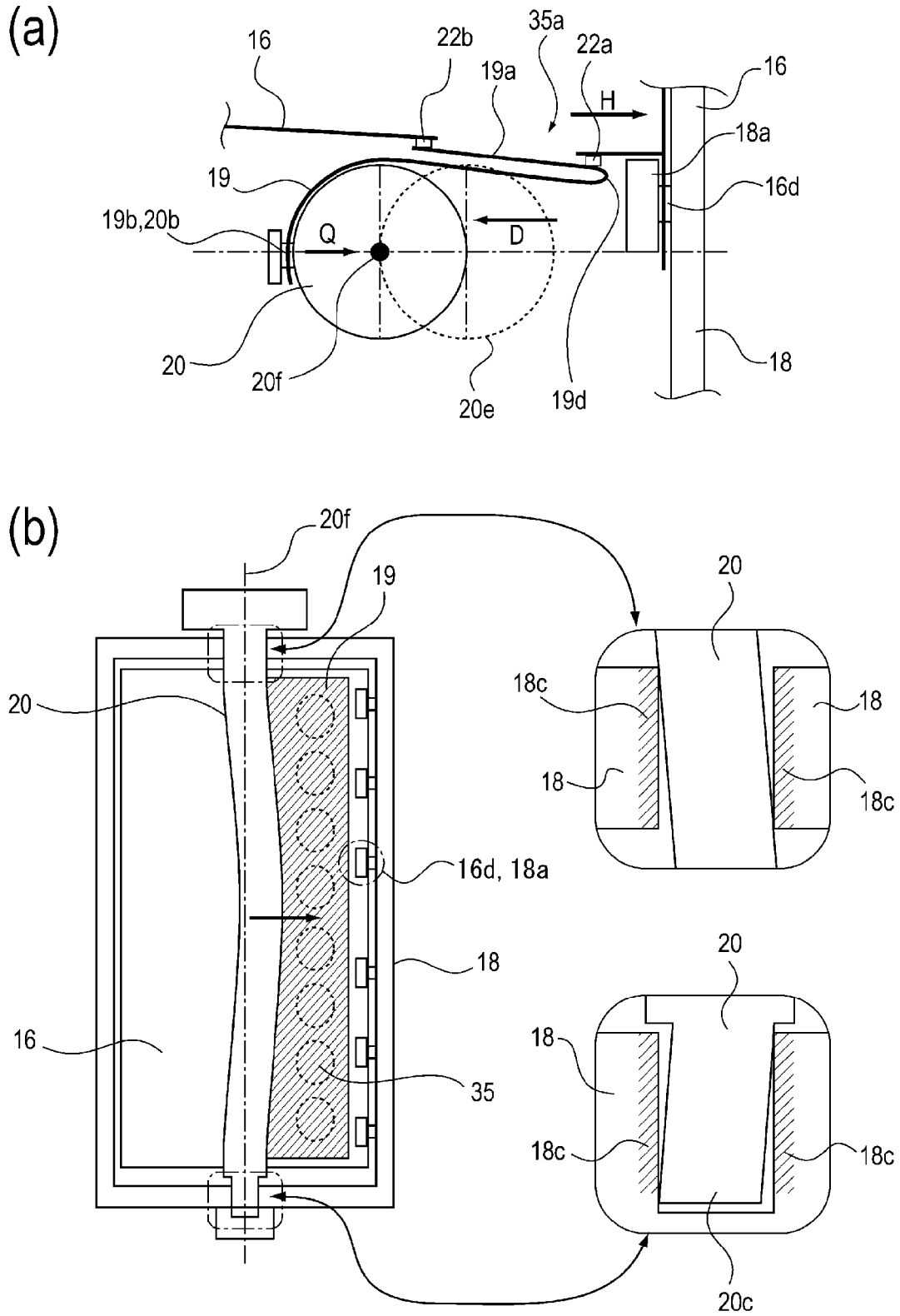

Parts (a) and (b) of FIG. 10 are sectional views showing a cross section of a peripheral portion of an opening of the developer accommodating container before the unsealing in the case where there is no limiting portion in First Embodiment in which (a) of FIG. 10 is the sectional view with respect to a direction perpendicular to a rotation shaft of the unsealing member, and (b) of FIG. 10 shows the cross section including a plane containing the rotation shaft of the unsealing member.

Figure 11:
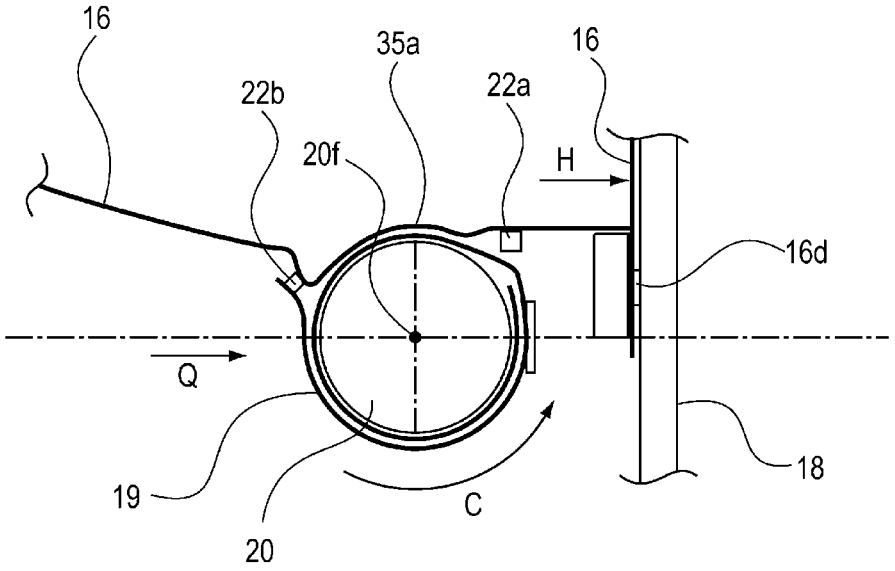

FIG. 11 is a schematic view showing a cross section of the peripheral portion of the opening of the developer accommodating container when an unsealing operation is performed in the case where there is no limiting portion in First Embodiment.

Figure 12:
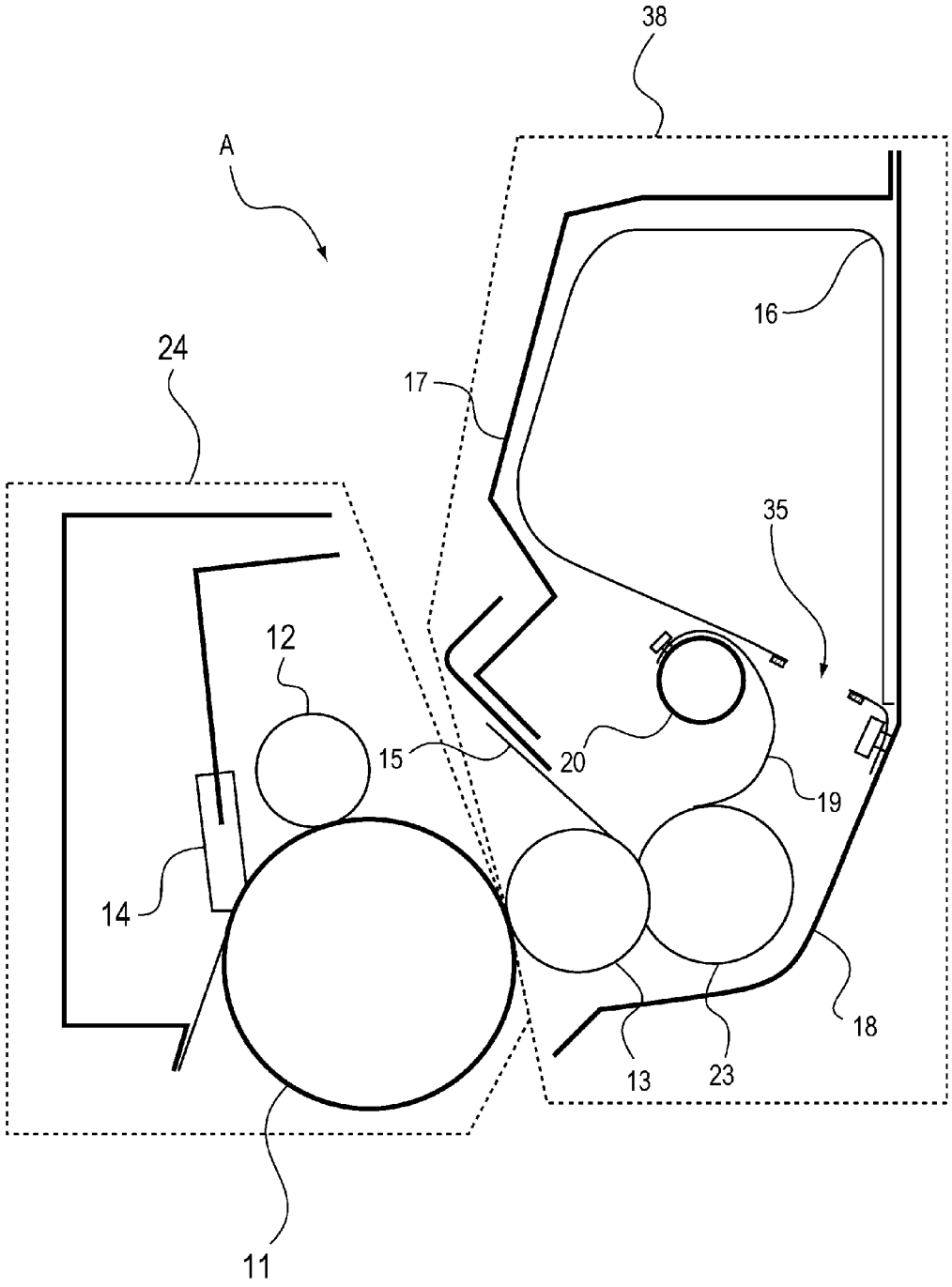

FIG. 12 is a sectional view of a process cartridge in the case where there is no limiting portion in First Embodiment.

Figure 13:
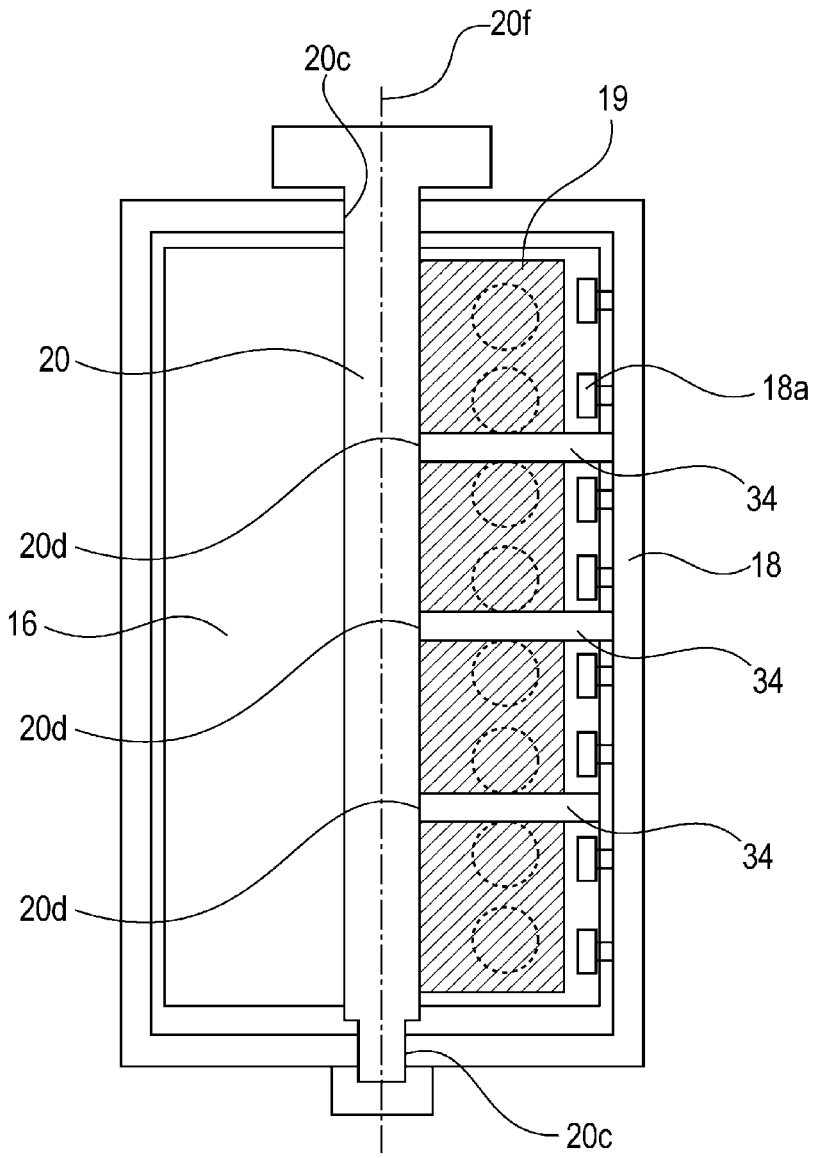

FIG. 13 is a sectional view of a developing device in the case where a plurality of limiting portions are provided in First Embodiment.

Figure 14:
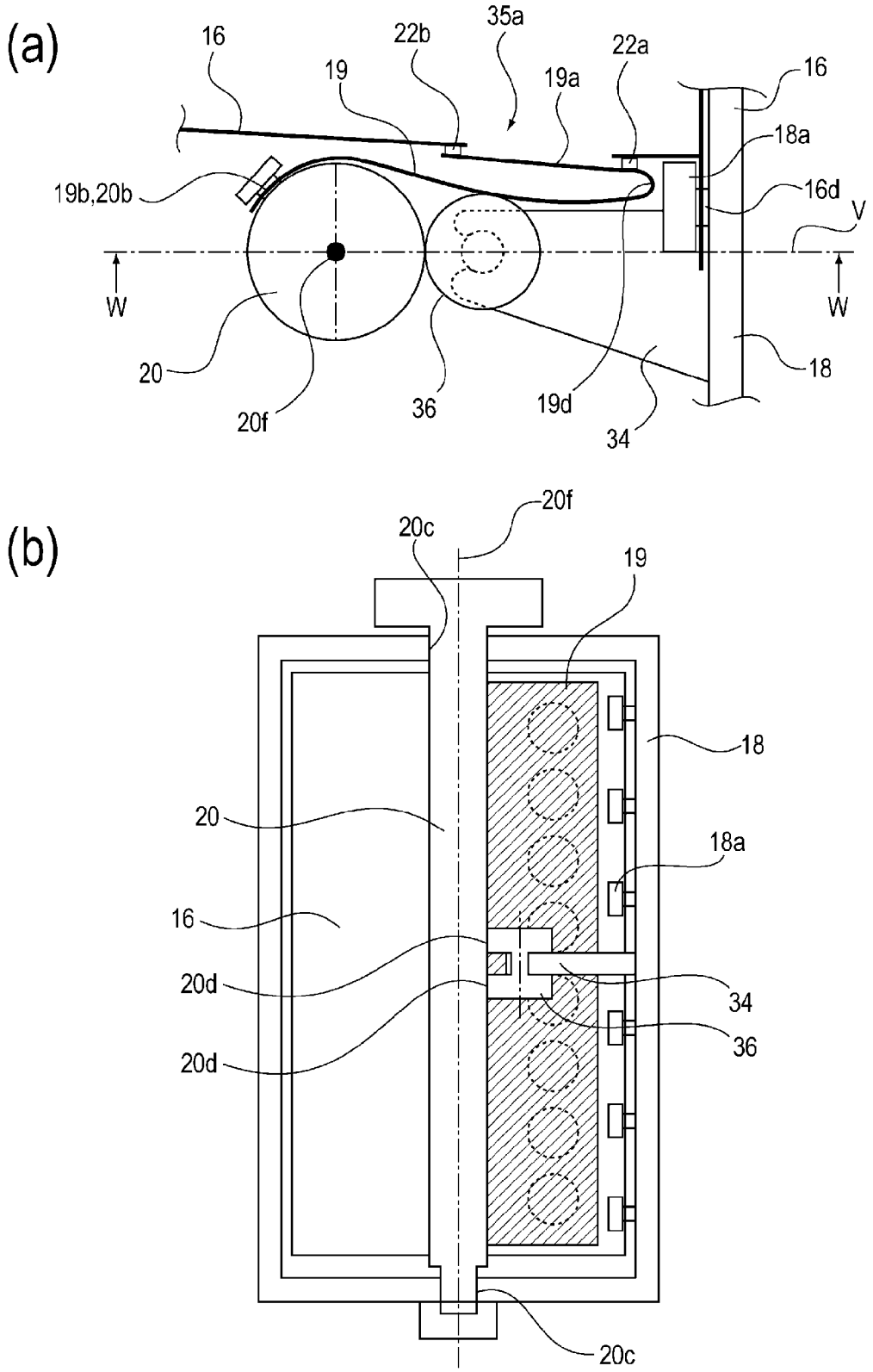

Parts (a) and (b) of FIG. 14 are sectional views showing a structure in the case where a limiting portion is provided with a roller member in First Embodiment in which (a) of FIG. 14 is the sectional view with respect to a direction perpendicular to a rotation shaft of the unsealing member, and (b) of FIG. 14 shows the cross section including a plane containing the rotation shaft of the unsealing member.

Figure 15:
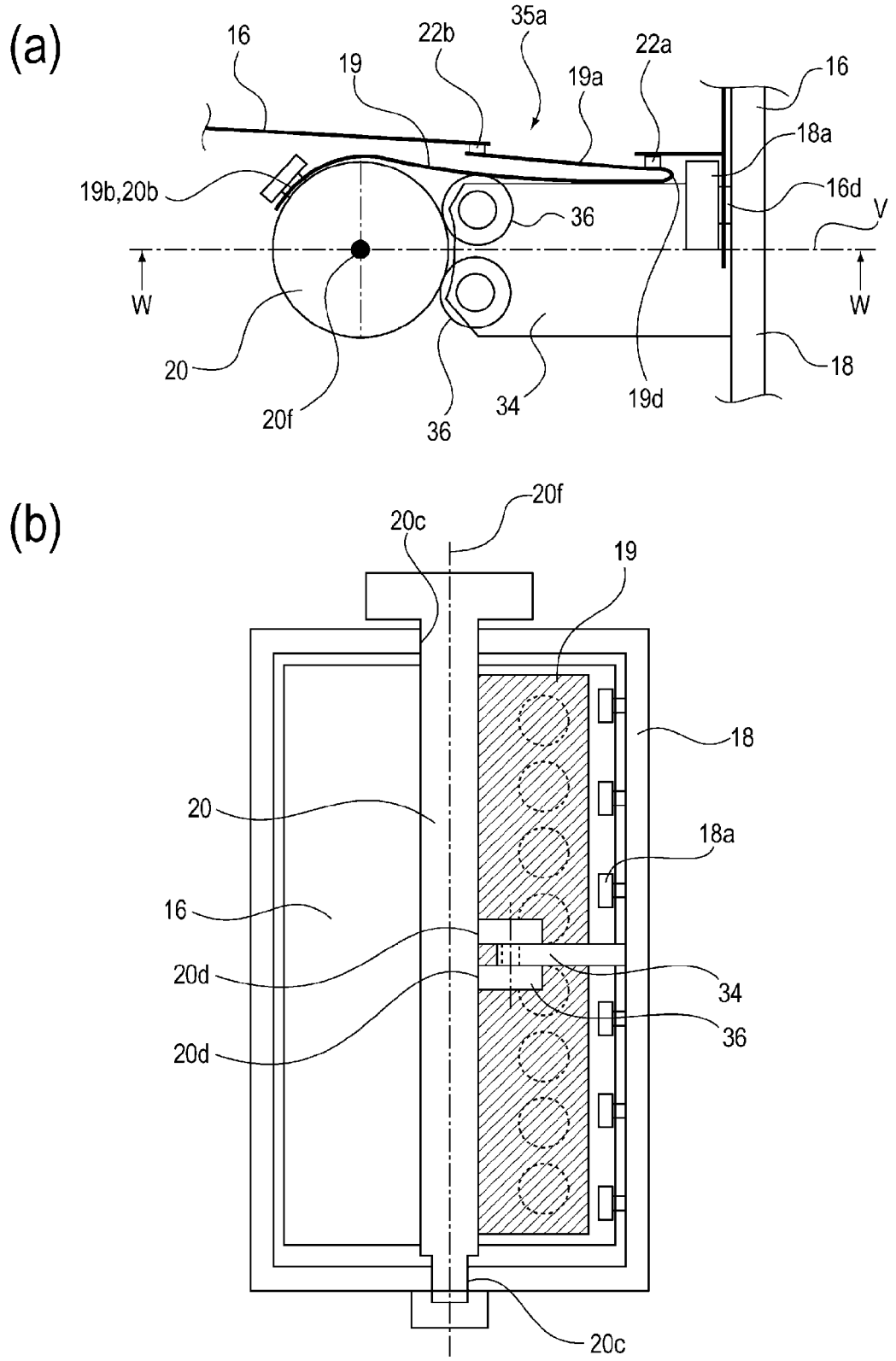

Parts (a) and (b) of FIG. 15 are sectional views showing a structure in the case where the limiting portion is provided with a plurality of roller members in First Embodiment in which (a) of FIG. 15 is the sectional view with respect to a direction perpendicular to a rotation shaft of the unsealing member, and (b) of FIG. 15 shows the cross section including a plane containing the rotation shaft of the unsealing member.

Figure 16:
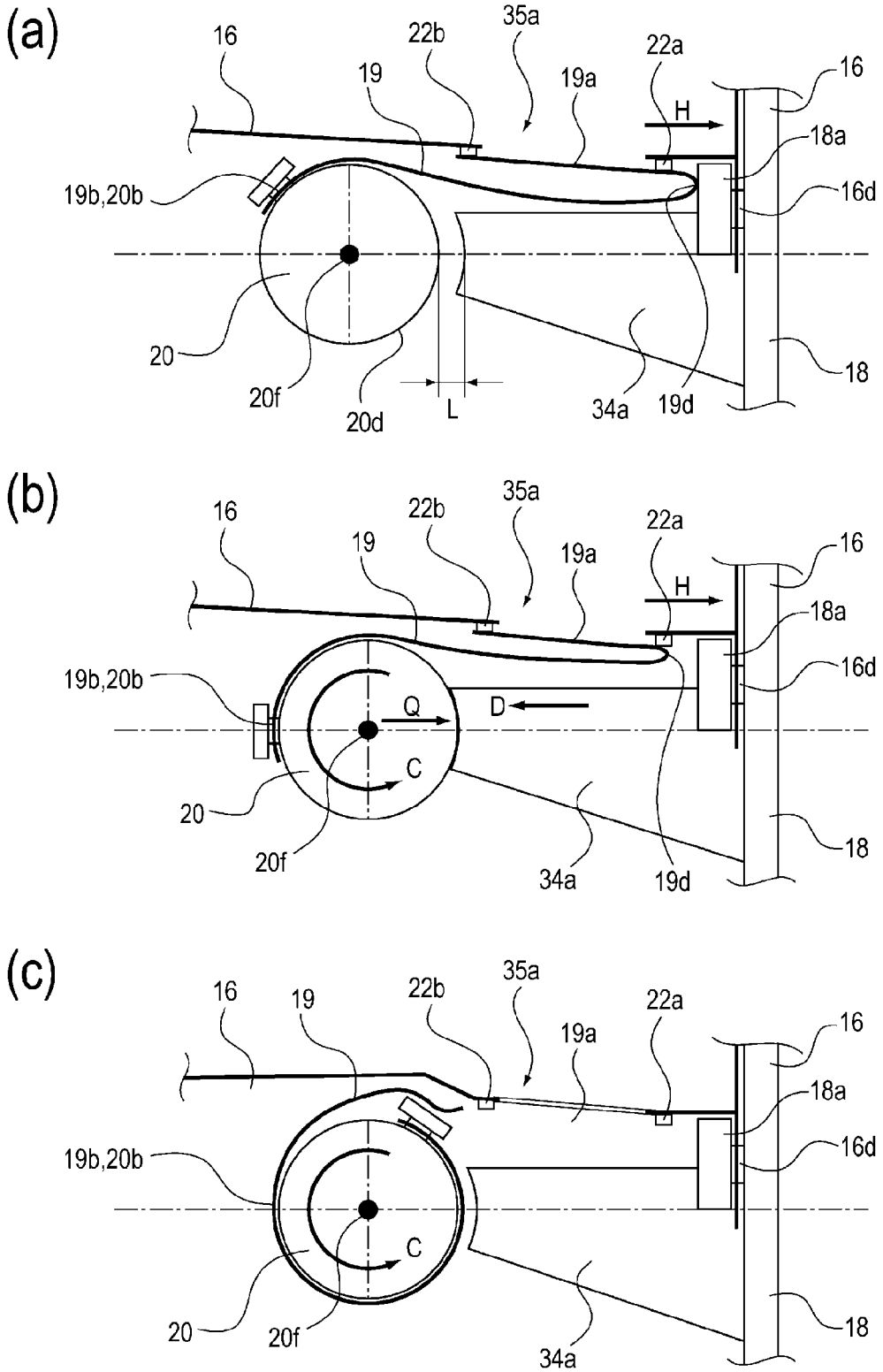

Parts (a), (b) and (c) of FIG. 16 are sectional views showing a peripheral portion of an opening of a developer bag in the case where a gap is provided between a limiting portion and an unsealing member in Second Embodiment, in which (a) of FIG. 16 shows a state before unsealing, (b) of FIG. 16 shows a state during the unsealing, and (c) of FIG. 16 shows a state after the unsealing.

Figure 17:
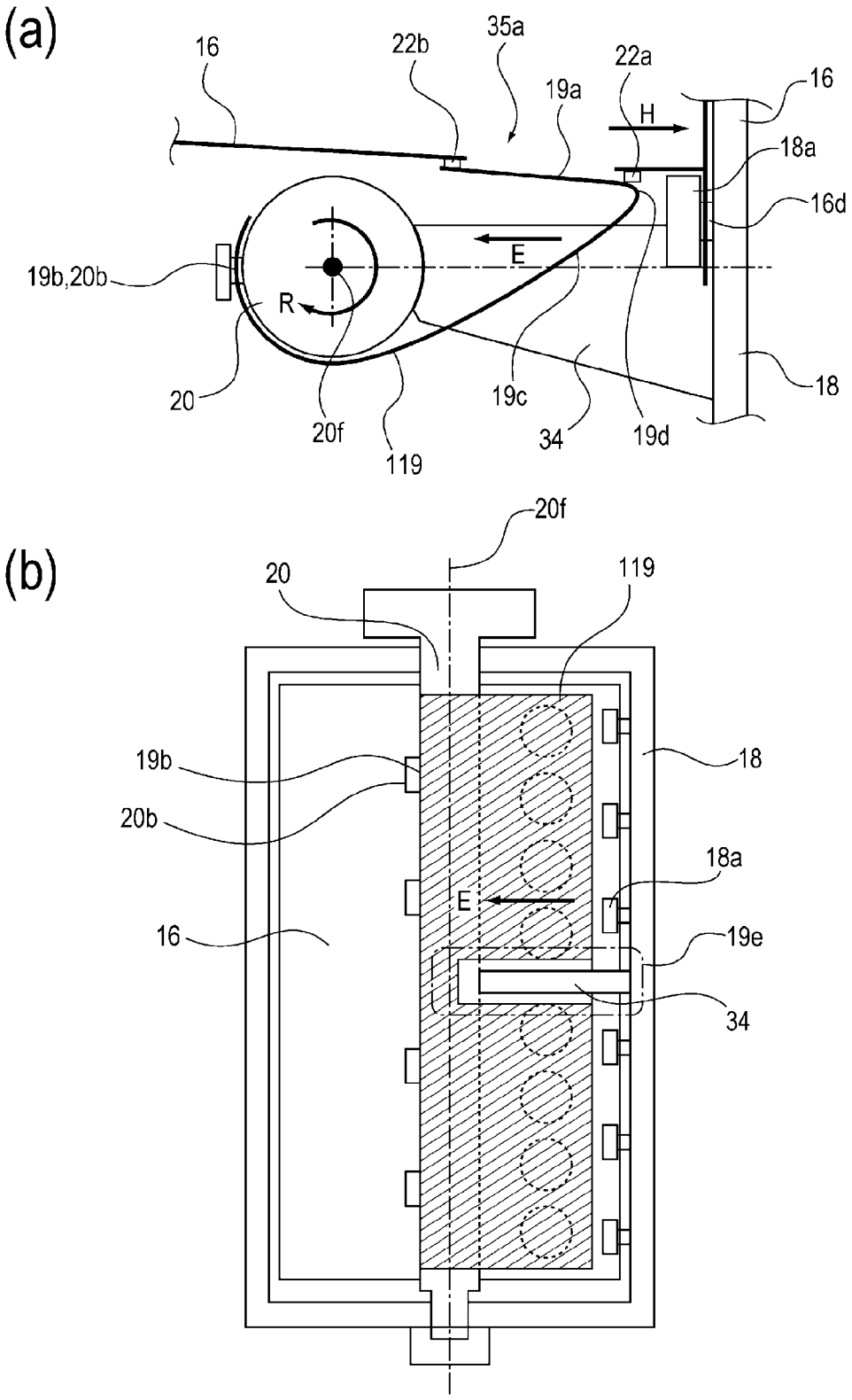

Parts (a) and (b) of FIG. 17 are sectional views showing a cross section of a peripheral portion of an opening of the developer accommodating container before the unsealing in the case where a sealing member is provided with a slit through which a limiting portion can enter in Third Embodiment in which (a) of FIG. 17 is the sectional view with respect to a direction perpendicular to a rotation shaft of the unsealing member, and (b) of FIG. 17 shows the cross section including a plane containing the rotation shaft of the unsealing member.

Figure 18:
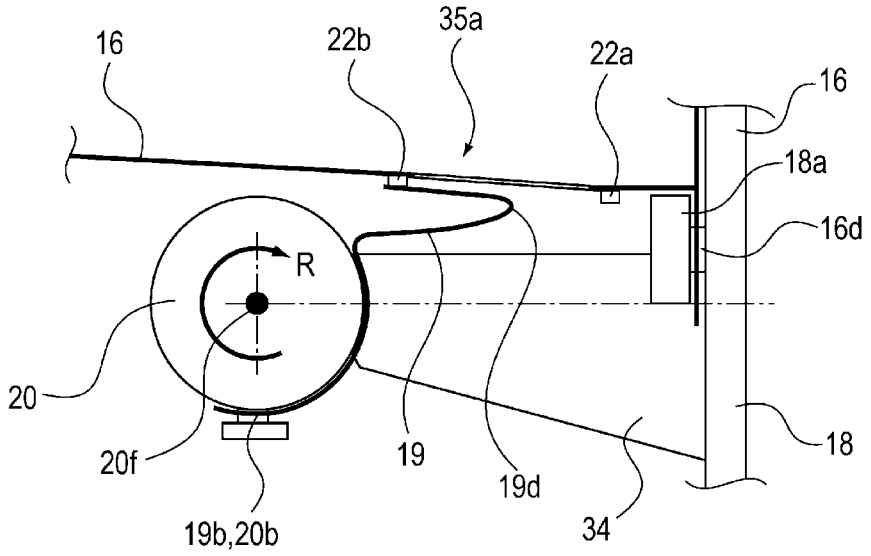

FIG. 18 is a sectional view of the peripheral portion of the opening of the developer accommodating container, with respect to the direction perpendicular to the rotation shaft of the unsealing member, before the unsealing in the case where the slit in Third Embodiment is not provided.

Figure 19:
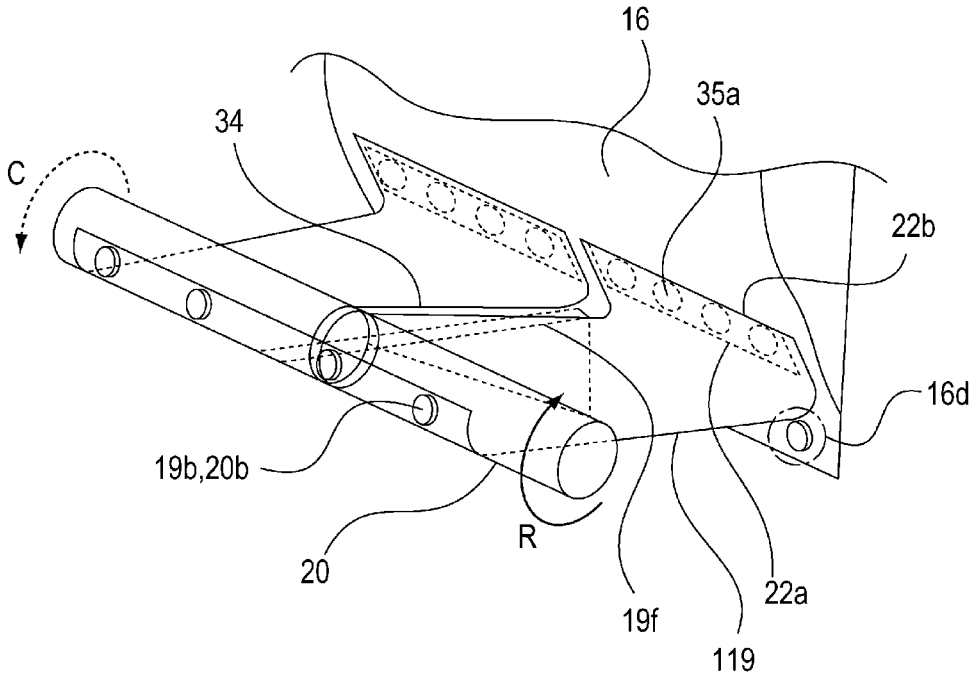
Figure 19:
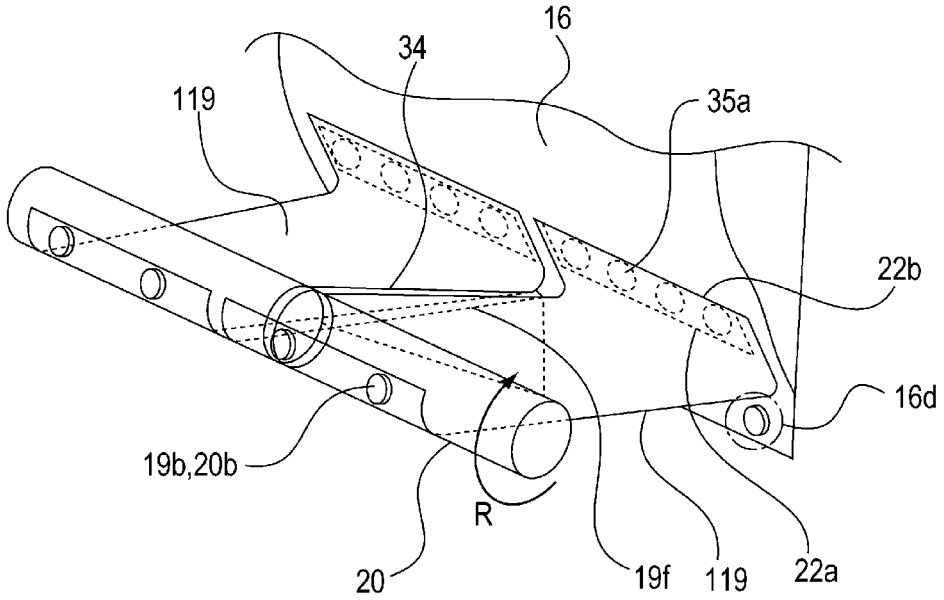

Parts (a) and (b) of FIG. 19 are perspective views each showing a developer accommodating bag and the sealing member in Third Embodiment in the case where the slit is provided, in which (a) of FIG. 19 shows the case where the slit is provided as a part of the sealing member so as to maintain a single sheet, and (b) of FIG. 19 shows the case where the slit is provided so as to separate the sealing member into two sheets.

Figure 20:
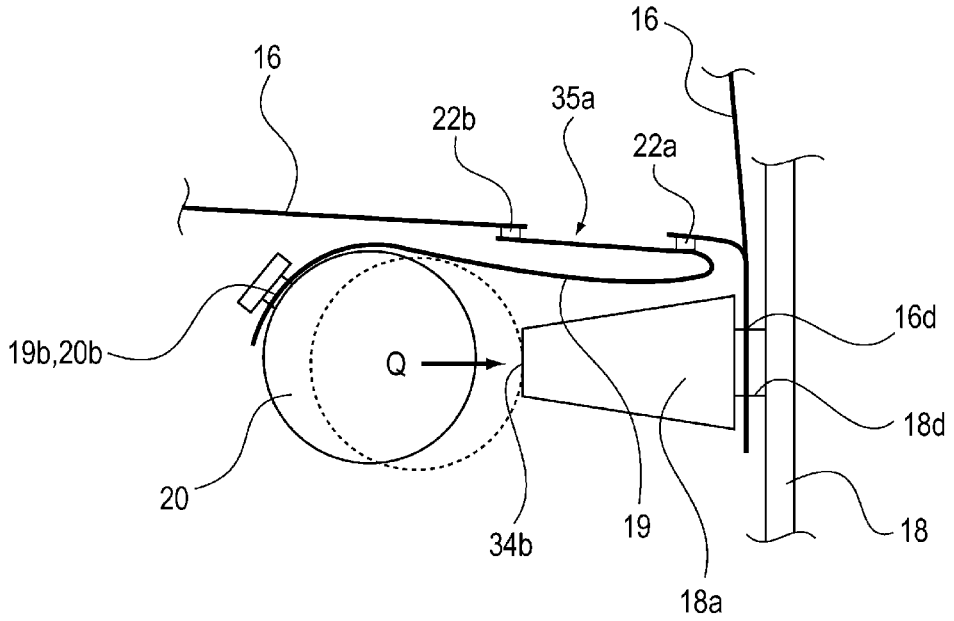
Figure 20:
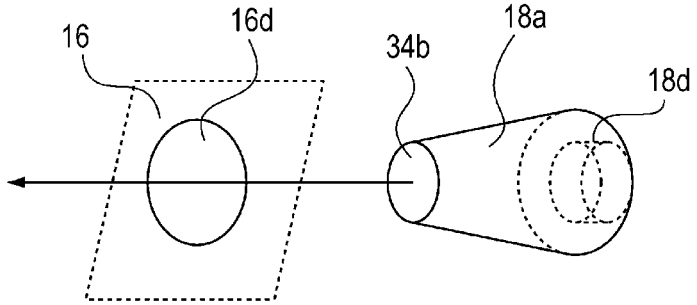
Figure 20:
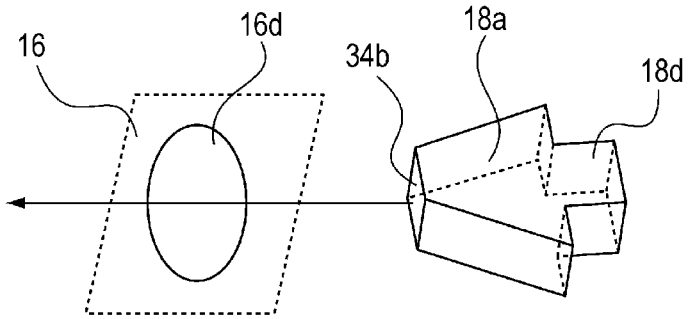

Parts (b), (b) and (c) of FIG. 20 are schematic views showing a cross section of a peripheral portion of an opening of a developer accommodating container before unsealing and a structure of a limiting portion in the case where the limiting portion is configured to also function as a fixing portion in Fourth Embodiment, in which (a) of FIG. 20 is a sectional view of the peripheral portion with respect to a direction perpendicular to a rotation shaft of an unsealing member, and (b) and (c) of FIG. 20 are perspective views each showing a fixing portion of a second frame and a fixing portion of a developer bag.

Figure 21:
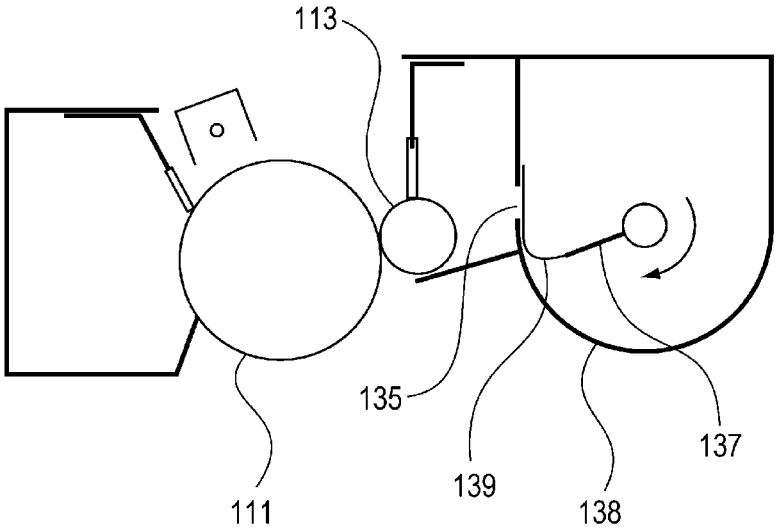

FIG. 21 is a sectional view showing a structure of a conventional process cartridge.

DESCRIPTION OF THE EMBODIMENTS

Hereinbelow, embodiments of the present invention will be specifically described with reference to the drawings.

In the following description, a developer accommodating container refers to at least a flexibility container and a sealing member for sealing an opening, provided to the sealing member, for permitting discharge of a developer.

A developer accommodating unit includes the developer accommodating container and a frame for accommodating the developer accommodating container.

First Embodiment

<General Structure of Image Forming Apparatus>

Figure 1:
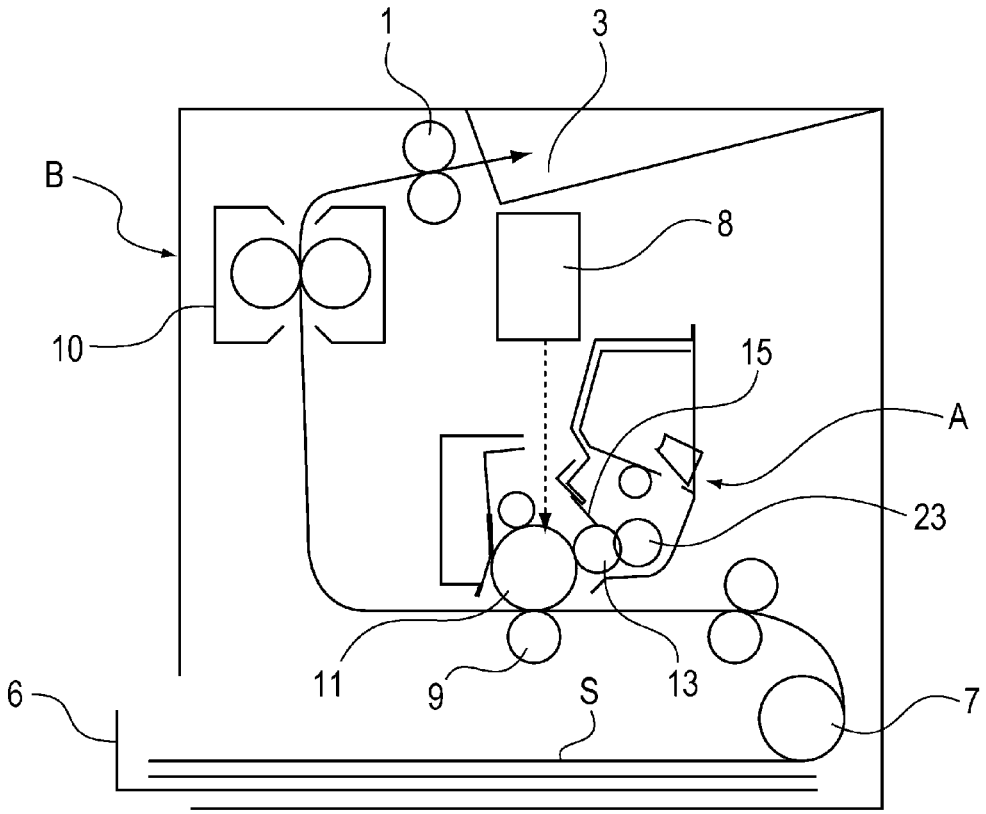
FIG. 1 is a sectional view of an image forming apparatus in First Embodiment of the present invention.

FIG. 1 is a sectional view of an image forming apparatus in this embodiment of the present invention.

As shown in FIG. 1, the image forming apparatus includes an image forming apparatus main assembly B and a process cartridge A detachably mountable to the image forming apparatus main assembly B. The process cartridge A is mounted in the image forming apparatus main assembly B during image formation.

Incidentally, the process cartridge A executes, when being mounted in the image forming apparatus main assembly B, at least a part of an image forming process.

In the image formation, a sheet S (recording material (medium)) is fed by a feeding roller 7 from a sheet cassette 6 mounted at a lower portion of the image forming main assembly B and in synchronism with this sheet feeding, a photosensitive drum 11 (image bearing member) is selectively exposed to light by an exposure device 8 to form a latent image. The developer is supplied to the developing roller 13 by the developer supplying roller 23 having a sponge shape and is carried in a thin layer on the surface of the developing roller 13. By applying a developing bias to the developing roller 13, the developer is supplied depending on the latent image and thus the latent image is developed into a developer image. This developer image is transferred onto the fed sheet S under bias voltage application to a transfer roller 9. The sheet S is conveyed to a fixing device 10, in which the image is fixed on the sheet S and then the sheet S is discharged to a discharge portion 3 at an upper portion of the image forming apparatus main assembly B.

<Structure of Process Cartridge>

Figure 2:
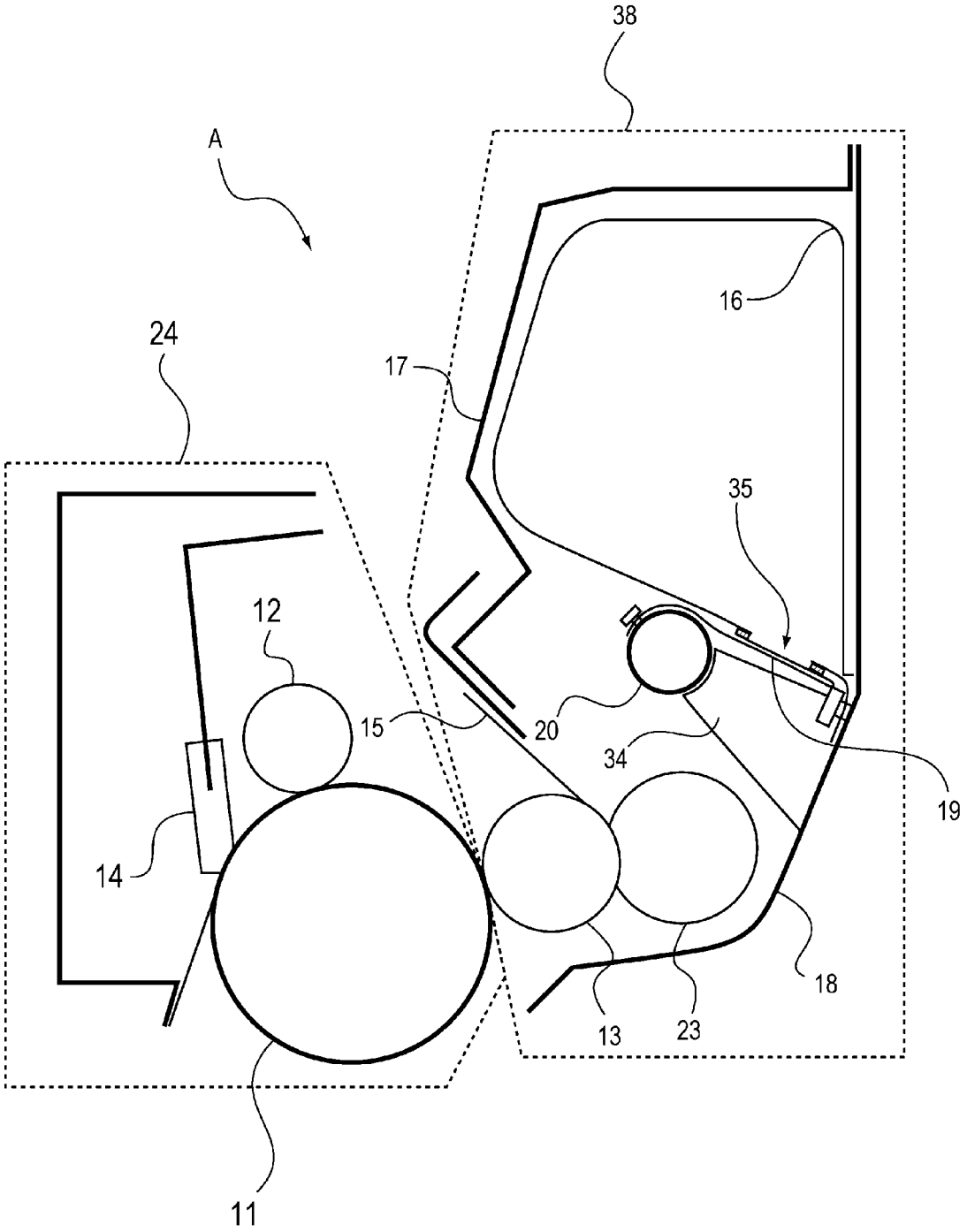
FIG. 2 is a sectional view showing a structure of a flexible container in First Embodiment.

FIG. 2 is a sectional view showing a structure of the process cartridge A shown in FIG. 1.

As shown in FIG. 2, the process cartridge A includes a cleaning unit 24 and a developing unit 38 connected with the cleaning unit 24, and is detachably mountable to the image forming apparatus main assembly B.

The cleaning unit 24 includes the photosensitive drum 11 for bearing the developer image, a charging roller 12 for electrically charging the photosensitive drum 11, and an elastic cleaning blade 14 for cleaning a peripheral surface of the photosensitive drum 11.

<Structure of Developing Unit>

Figure 3:
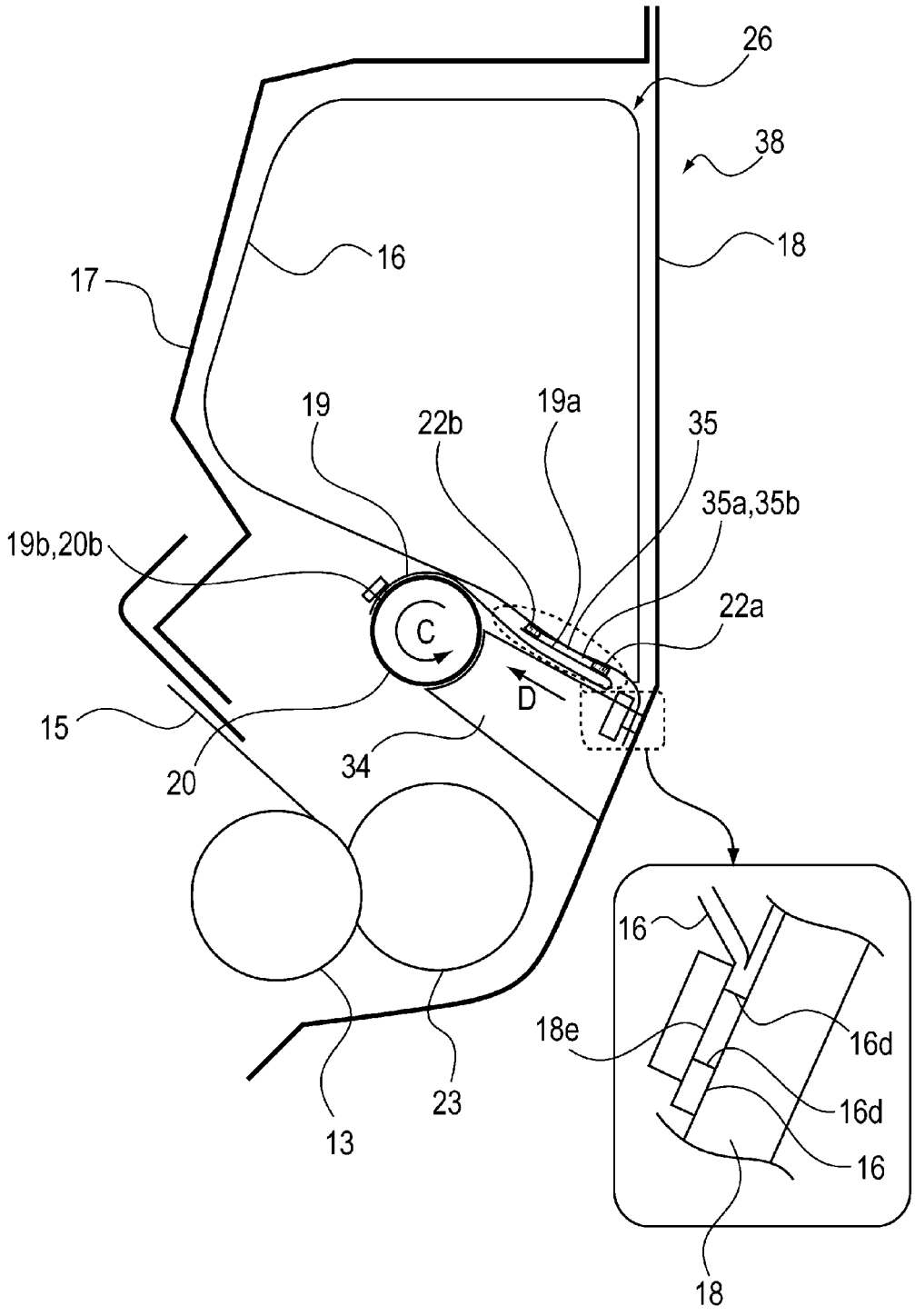
FIG. 3 is a sectional view showing a structure of a developing device in First Embodiment.

FIG. 3 is a sectional view showing a structure of the developing unit 38.

The developing unit 38 includes a first frame 17 and a second frame 18. In a space between the first frame 17 and the second frame 18, the developing roller 13, the developing blade 15, the developer supplying roller 23, and a developer accommodating container 26 for accommodating the developer are accommodated. Incidentally, the developing roller 13 and the developing blade 15 are supported by the first frame 17.

Incidentally, in this embodiment, in the developing unit 38, process means such as the developing roller 13, the developing blade 15 and the developer supplying roller 23, and the developer accommodating container 26 accommodating the developer are provided in the same frame unit. However, the developer accommodating container 26 may also be constituted so as to be provided in a frame unit different from the frame unit of the developing unit 38.

<Structure of Developer Bag>

As shown in FIG. 3, a developer bag 16 accommodating the developer therein and has a bag-like shape which is deformable, and is provided with the plurality of openings 35*a* at the discharging portion 35 for permitting the discharge of the accommodated developer.

Further, the developer bag 16 includes a fixing portion 16*d* constituting a hole engaged with a boss 18*a* (fixing portion) fixed to the second frame 18.

(Structure of Discharging Portion of Developer Bag)

Figure 4:
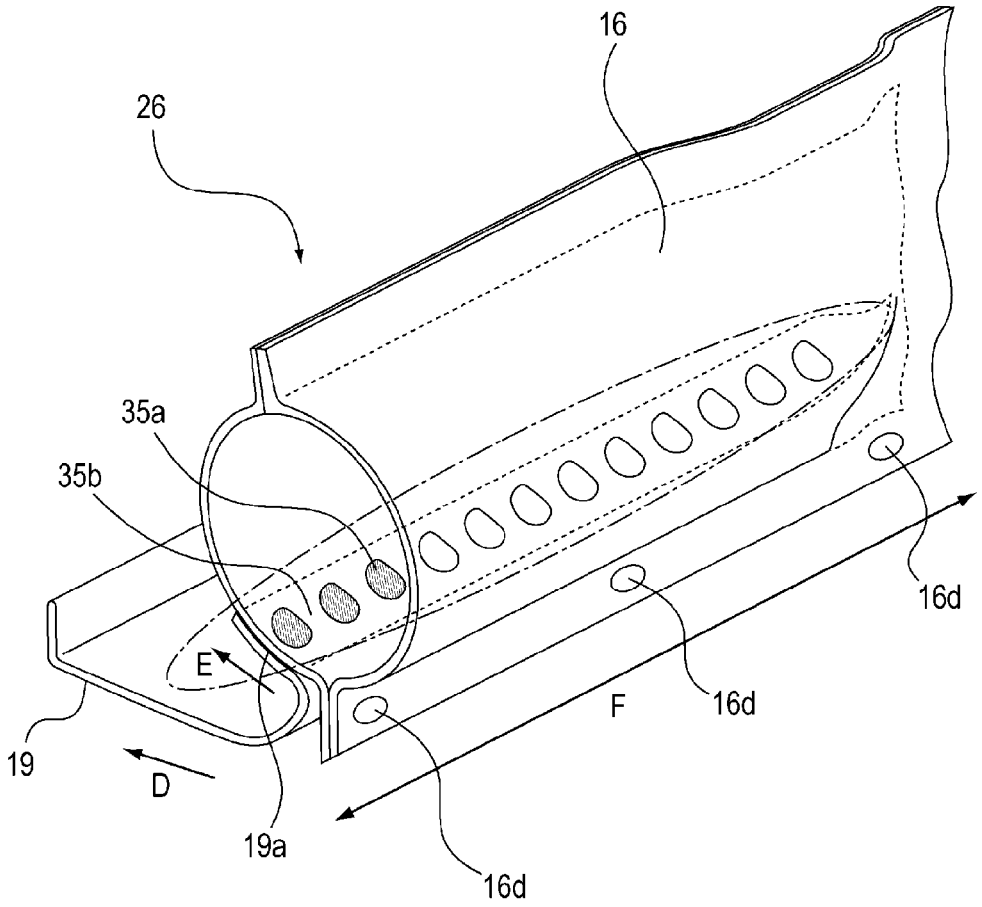
FIG. 4 is a perspective view of a developer accommodating container in First Embodiment 1.

FIG. 4 is a perspective view of the developer accommodating container 16.

As shown in FIG. 4, the developer bag 16 includes the developer discharging portion 35 consisting of the plurality of openings 35*a* for permitting the discharge of the developer therein and the connecting portions 35*b* connecting the plurality of openings 35*a*. Further, the discharging portion 35 is continuously surrounded by the sealing member 19 to be unsealably bonded, so that the developer accommodated in the developer bag 16 is sealed with the sealing member 19.

(Structure of Bonding Portion of Developer Bag)

Figure 5:
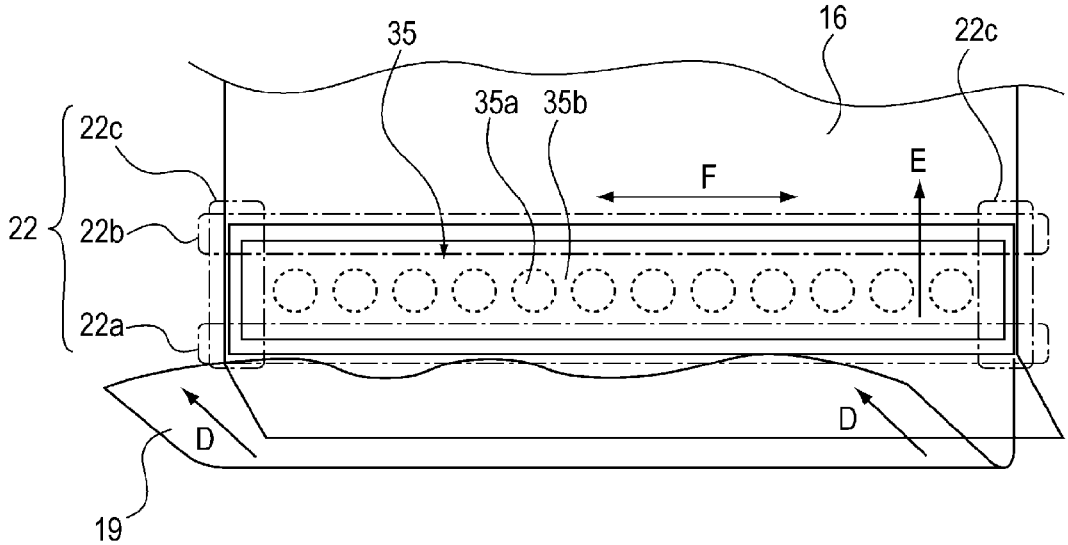
FIG. 5 is a schematic view showing a discharging portion of a developer bag of the developer accommodating container before the developer accommodating container is unsealed by a sealing member in First Embodiment.

FIG. 5 is a schematic view showing the discharging portion 35 of the developer bag 16 of the developer accommodating container 26 before the developer accommodating container 26 (force) is unsealed by the sealing member 19.

The bonding portion 22 has a rectangular shape consisting of two lines extending in a longitudinal (long) direction (arrow F direction) and two lines extending in a widthwise (short) direction (arrow E direction) so as to surround the discharging portion 35 and therefore the bonding portion 22 enables the sealing of the discharging portion 35.

Here, of the two lines of the welded bonding portion 22 extending in the longitudinal direction (arrow F direction), a bonding portion which is first unsealed is referred to as a first bonding portion 22*a* and a bonding portion which is unsealed later is referred to as a second bonding portion 22*b*. Further, a bonding portion opposing the first bonding portion 22*a* via the opening 35*a* is the second bonding portion 22*b*. Further, a bonding portion with respect to the widthwise direction is a widthwise bonding portion 22*c*.

In this embodiment, an unsealing direction is the arrow E direction. The unsealing direction is defined as follows. In the case where the unsealing is effected by moving the sealing member 19, of the first bonding portion 22*a* and the second bonding portion 22*b* opposing to each other via the opening 35*a*, the first bonding portion 22*a* is first unsealed (peeled). Thus, a direction directed from the first bonding portion 22*a* to be first unsealed toward the second bonding portion 22*b* is the unsealing direction indicated by the arrow E.

(Disposition of Openings of Developer Bag)

Figure 6:
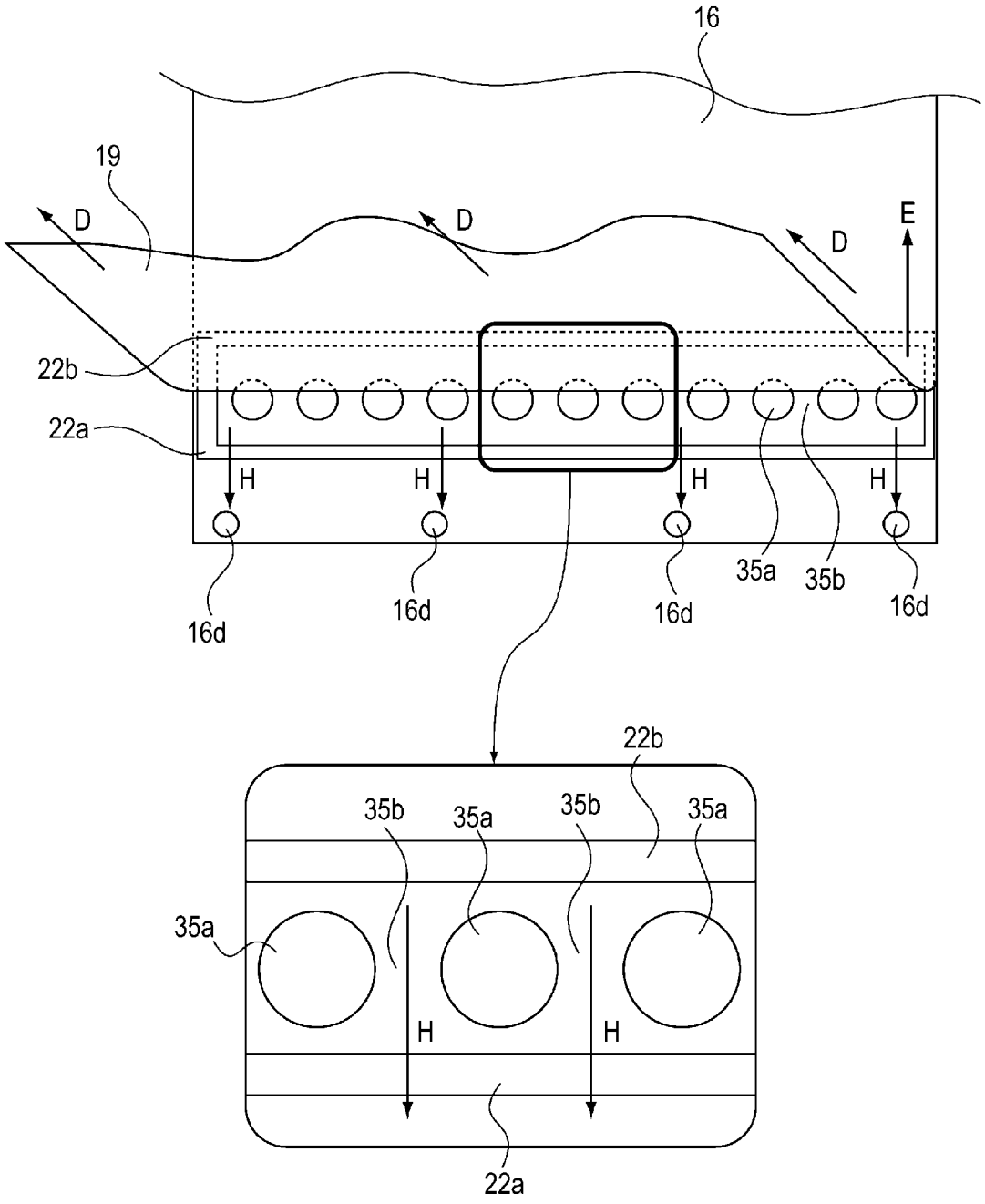
FIG. 6 is a schematic view showing the discharging portion of the developer bag of the developer accommodating container during the unsealing of the developer accommodating container by the sealing member in First Embodiment.

FIG. 6 is a schematic view showing the discharging portion 35 of the developer bag 16 of the developer accommodating container 26 during the unsealing of the developer accommodating container 26 by the sealing member 19.

Next, disposition of the openings 35*a* will be described with reference to FIGS. 5 and 6. The sealing member 19 seals and exposes the openings 35*a* by being pulled in an arrow D direction by the unsealing member 20. By the movement of the sealing member 19, the exposure of the openings 35*a* progresses in the unsealing direction of the arrow E. In the following, the movement direction of the sealing member 19 is the arrow D direction.

The plurality of openings 35*a* and the plurality of connecting portions 35*b* are alternately shifted and disposed along the arrow F direction perpendicular to the unsealing direction of the arrow E. Further, the sealing member 19 is configured to be wound up by rotating the unsealing member 20 but the arrow F direction is the same direction as an axis (axial line) of the rotation shaft of the unsealing member 20.

(Fixing Between Developer Bag and Frame)

As shown in FIG. 3, the developer bag 16 is fixed inside the second frame 18 by the fixing portion 16*d*.

Further, the fixing portion 16*d* receives a force when the sealing member 19 is unsealed (removed) from the developer bag 16. The first fixing portion 16*d* is provided at a plurality of positions, in parallel to the direction of the arrow F along which the plurality of openings 35*a* are arranged, correspondingly to the positions of the openings 35*a*.

(Fixing Method Between Developer Bag and Frame)

As a fixing method between the developer bag 16 and the fixing portion 16*d*, fixing using ultrasonic clamping such that the boss 18*a* of the second frame 18 is inserted into a hole of the developer bag 16 and then is crushed is used. Incidentally, as a fixing means, other than the ultrasonic clamping, it is also possible to use means without using ultrasonic wave, such as fixing using hooking.

<Structure of Sealing Member>

Parts (a) and (b) of FIG. 7 are sectional views showing a peripheral portion of the openings 35*a* of the developer accommodating container 26 before the unsealing, in which (a) of FIG. 7 is the sectional view with respect to a direction perpendicular to the rotation shaft of the unsealing member 20, and (b) of FIG. 7 is the sectional view showing a cross section including a plane containing the rotation shaft of the unsealing member 20. That is, (b) of FIG. 7 is the sectional view, as seen from an arrow W direction, of a plane indicated by a chain line V passing through the center of the rotation shaft of the unsealing member 20 in (a) of FIG. 7.

As shown in FIG. 7, the sealing member 19 covers the openings 35*a* of the developer bag 16 before use of the process cartridge A to confine the developer in the developer bag 16. The sealing member 19 exposes the openings 35*a* by being pulled by the unsealing member 20.

The sealing member 19 is constituted by a sheet-like sealing member including a sealing portion 19*a* for covering (sealing) the openings 35*a* of the developer bag 16, the engaged portion 19*b* to be fixed (engaged) with the unsealing member 20, and a connecting portion 19*c* which connects the sealing portion 19*a* and the engaged portion 19*b*. The sheet is formed of a laminate material having a sealant layer which exhibits an easy-unsealing property, and a base material therefor is polyethylene telephthalate (PET), polyethylene, polypropylene or the like. A thickness of the sheet-like sealing member may appropriately be set in a range of 0.03-0.15 mm.

(Sealing Portion of Sealing Member)

A sealing portion 19*a* covers a region where the plurality of openings 35*a* and the plurality of connecting portions 35*b* of the developer bag 16 are sealed. For this reason, the developer is prevented from being leaked from the inside of the developer bag 16 before use of the process cartridge A.

(Engaging Portion of Sealing Member)

As shown in FIG. 3, the sealing member 19 has a free end portion in one end side thereof with respect to the arrow d direction, and at the free end portion, the engaged portion 19*b* to be engaged with the unsealing member 20 for moving the sealing member 19 is provided. With the engaged portion 19*b*, the unsealing member 20 for pulling the sealing member 19 so as to expose the openings 35*a* is engaged. The unsealing member 20 may also be configured to automatically perform the unsealing by receiving a driving force from the image forming apparatus main assembly B. Or, the unsealing member 20 may also be configured to perform the unsealing by being held and moved by the user.

In this embodiment, the unsealing member 20 is a rotation shaft provided in the frame, and the sealing member 19 engaged with the unsealing member 20 is pulled, so that the developer accommodating container 26 accommodating the developer is unsealed.

(Sealing Member Connecting Portion of Sealing Member)

As shown in (a) of FIG. 7, a portion for connecting the bonding portion 22 and the engaged portion 19*b* of the sealing member 19 is the sealing member connecting portion 19*c*. The (sealing member) connecting portion 19*c* is a portion for transmitting a force so as to pull off the bonding portion 22 by receiving the force from the unsealing member 20.

(Fixing of Sealing Member)

Fixing between the sealing member 19 and the unsealing member 20 is made by the ultrasonic clamping similarly as the fixing portion 16*d*. Other than the ultrasonic clamping, it is also possible to use thermal welding, ultrasonic welding, bonding, insertion between frames, hooking by a hole and a projection, and the like.

(Portion Having Easy-Unsealing Property of Sealing Member)

A method of providing a peeling force of the bonding portion 22 with a desired value will be described. In order to provide the peeling force with the desired value (a minimum force within a range in which the toner sealing property can be maintained), two methods are principally employed.

In a first method, a laminate material having a sealant layer for enabling easy unsealing of the sealing member is applied. Further, the first method is a method in which the easy unsealing is enabled at the bonding portion by using, as the material for the developer bag 16, a sheet material (of, e.g., polyethylene or polypropylene) which is weldable with the sealant layer and which has flexibility. By changing a combination of formulation of the sealant layer with the material to be bonded, the peeling force can be adjusted correspondingly to a desired condition. A material having a peeling strength of about 3N/15 mm measured by testing methods for heat sealed flexible packages (JIS-Z0238) is used.

A second method is a method in which as shown in FIG. 3, the discharging portion 35 of the developer bag 16 is placed in a state in which the sealing member 19 is folded back with respect to the arrow D direction in which the sealing member 19 is pulled. For example, in the state of FIG. 3, the unsealing member 20 is rotated (in an arrow C direction), so that the sealing member 19 is pulled in a pulling direction (arrow E direction) by the unsealing member 20. By placing the sealing member 19 in the fold-back state, the developer bag 16 and the sealing member 19 provide an inclined peeling positional relationship in which an angle between the surface of the bonding portion 22 of the developer bag 16 and the surface along the pulling direction (arrow D direction) of the sealing member 19 is 90 degrees or less. It has been conventionally known that the peeling force necessary to separate the both surfaces can be reduced by establishing the inclined peeling positional relationship, and the sealing member 19 at the bonding portion 22 and the developer bag 16 are placed in the inclined peeling positional relationship and thus the peeling force can be adjusted so as to be reduced.

<Structure of Unsealing Member>

As shown in FIG. 5, the unsealing member 20 peels off the sealing member 19 from the developer bag 16 by applying a force to the sealing member 19 to pull the sealing member 19. The unsealing member 20 includes a supported portion 20*c* which has a shaft shape and which rotatably supports the second frame 18 at its end portions, and includes an engaging portion 20*b* to which the engaged portion 19*b* of the sealing member 19 is fixed.

Further, a limited portion 20*d*, having a circular cross section to be limited by a limiting portion 34 of the second frame 18 is provided. A portion where the unsealing member 20 winds up the sealing member 19 has a round shaft shape.

Incidentally, the limiting portion 34 will be specifically described later.

<Unsealing Operation of Developer Accommodating Container>

Next, the unsealing of the developer accommodating container 26 will be described.

Parts (a) and (b) of FIG. 8 are sectional views showing a process in which the sealing member 19 is unsealed by the unsealing member 20 by peeling the first bonding portion 22*a*, in which (a) of FIG. 8 shows a stage in which the peeling of the first bonding portion 22*a* is started, and (b) of FIG. 8 shows a stage in which the peeling of the first bonding portion 22*a* is completed.

As shown in these figures, a boss 18*a* for fixing the developer bag 16 to be pulled for the unsealing is provided on the second frame 18.

The unsealing member 20 is rotated in the arrow C direction by transmission of the driving force thereto from the main assembly by an unshown driving means.

Further, as shown in (a) of FIG. 8, the sealing member 19 is pulled by further rotation of the unsealing member 20 to start the unsealing of the first bonding portion 22*a*. With the rotation of the unsealing member 20, the sealing member 19 fixed at the engaged portion 19*b* is pulled in the arrow D direction.

When the sealing member 19 is pulled, the developer bag 16 is pulled via the bonding portion 22. The sealing member 19 pulls the developer bag 16 in the arrow D direction, and by reaction force thereof, the developer bag 16 pulls the sealing member 19 in the direction of the boss 18*a* which is an arrow H direction.

Further, the unsealing member 19 is folded back at a fold-back portion 19*d* between the first bonding portion 22*a* and the engaged portion 19*b* and therefore the force is applied to the portion of the first bonding portion 22*a* so as to be inclination-peeled in the arrow D direction. Then, the peeling of the first bonding portion 22*a* is effected to start the unsealing of the discharging portion 35.

As shown in (c) of FIG. 8, when the unsealing is advanced with further rotation of the unsealing member 20, also the fold-back portion 19*d* is moved in the arrow D direction, so that the unsealing is further advanced to expose the openings 35*a*.

Parts (a) and (b) of FIG. 9 are sectional views showing a process in which the sealing member 19 is unsealed by the unsealing member 20 by peeling the second bonding portion 22*b*, in which (a) of FIG. 9 shows a stage in which the peeling of the second bonding portion 22*b* is started, and (b) of FIG. 8 shows a stage in which the peeling of the second bonding portion 22*b* is completed.

As shown in these figures, when the peeling of the second bonding portion 22*b* is started after the openings 35*a* are exposed, similarly as in the peeling of the first bonding portion 22*a*, when the sealing member 19 pulls the developer bag 16, by reaction force, the developer bag 16 pulls the sealing member 19 in the arrow H direction which is the direction of the boss 18*a*. Then, as shown in (b) of FIG. 9, the force is applied to the portion of the bonding portion 22*b* in the arrow D direction, so that the second bonding portion 22*b* is peeled, and thus the unsealing is completed. Then, the developer inside the developer bag 16 is discharged in an arrow I direction through the openings 35*a* of the discharging portion 35.

Thus, the sealing member 19 is wound up around the unsealing member 20 by the rotation of the unsealing member 20, so that the bonding portion 22 is unsealed.

(Structure of Limiting Portion)

Next, the limiting portion 34 for limiting the movement of the unsealing member 20 will be described.

As shown in (b) of FIG. 7, with respect to a rotational axis direction (rotation shaft direction) of the unsealing member 20, the limiting portion 34 is provided in the neighborhood of the center of the second frame 18. In this embodiment, the limiting portion 34 is provided as a part of the second frame 18, but may also be provided as a separate member fixed to the second frame 18 due to a convenience of manufacturing, assembling and the like of the second frame 18.

As shown in (a) of FIG. 8, during unsealing, a force of the engaged portion 19*b* of the sealing member 19 is applied to the unsealing member 20 in an arrow H direction. For this reason, the unsealing member 20 is flexed so as to approach the boss 18*a*. However, the limiting portion 34 is provided and therefore movement of the unsealing member 20 is limited by the limiting portion 34. In this way, the limiting portion 34 for limiting deformation of the unsealing member 20 in at least one position inside the end portions of the second frame 19 with respect to the rotational axis direction of the unsealing member 20 is provided on the second frame 18. For this reason, it is possible to obviate a state in which it is difficult to unseal the sealing member 19 by flexure of the unsealing member 20 during the unsealing as described below.

Incidentally, as shown in FIG. 8, when the unsealing member 20 winds up the sealing member 19, the limiting portion 34 limits the deformation of the unsealing member 20 with respect to a direction, crossing a rotation shaft 20*f* of the unsealing member 20, which is the direction in which the unsealing member 20 receives the force from the sealing member 19.

Further, as shown in FIG. 8, the limiting portion 34 is a projected portion elongated from the second frame 18 toward the unsealing member 20.

<Comparison with Case where there is No Limiting Portion>

Parts (a) and (b) of FIG. 10 are sectional views each showing a peripheral portion of the openings 35*a* of the developer accommodating container 26 before the unsealing in the case where there is no limiting portion 34, in which (a) of FIG. 10 is the sectional view with respect to a direction perpendicular to the rotation shaft of the unsealing member 20, and (b) of FIG. 10 shows a cross section of a plane including the rotation shaft of the unsealing member 20.

As shown in (a) of FIG. 10, during unsealing, a pulling force of the engaged portion 19*b* of the unsealing member 19 is added in the direction of the arrow H during the unsealing, and in the case where there is no limiting portion 34, to the unsealing member 20, a force by which the unsealing member 20 approaches the boss 18*a* is applied. For that reason, the center portion of the unsealing member 20 is deformed with respect to an arrow Q direction to be moved to a position 20*e*.

When the unsealing member 20 is deformed with respect to the arrow Q direction, the end portions of the unsealing member 20 are in a state as shown in (b) of FIG. 10. That is, a supporting portion 18*c* of the second frame 18 for supporting the unsealing member 20 rotatably supports a supported portion 20*c* of the unsealing member 20.

The supported portion 20*c* of the unsealing member 20 and the supporting portion 18*c* are engaged with each other with a spacing for permitting rotational sliding of the unsealing member 20. During the unsealing in which the openings 35*a* are exposed, when the unsealing member 20 is deformed with respect to the arrow Q direction, the supported portion 20*c* of the unsealing member 20 is inclined toward and contacted to the supporting portion 18*c*. For this reason, the supported portion 20*c* pries the supporting portion 18*c* and therefore prevents the rotational sliding of the unsealing member 20, thus increasing a rotation torque.

However, as in this embodiment, by providing the limiting portion 34, it is possible to limit the inclination of the unsealing member 20 in the arrow Q direction. For this reason, it is possible to prevent the supported portion 20*c* to pry the supporting portion 18*c* as described above, so that an effect of preventing the increase in rotation torque of the unsealing member 20 is achieved.

FIG. 11 shows a cross section of a peripheral portion of the openings 35*a* of the developer accommodating container 26 when the unsealing operation is performed in the case where there is no limiting portion 34.

As shown in the figure, when a portion of the unsealing member 20 in the neighborhood of the center with respect to the rotational axis direction is deformed with respect to the arrow Q direction while the second bonding portion 22*b* is not deformed, a portion in the neighborhood of the second bonding portion 22*b* is wound about the unsealing member 20.

There is a fear that such a state causes a difficulty in easy unsealing of the sealing member 19 since a plane of the bonding portion 22 of the developer bag 16 and a plane of the sealing member 19 along the arrow D direction in which the sealing member is pulled are out of a positional relationship of inclination peeling of 90 degrees or less ((a) of FIG. 8).

As described above, in the case where there is no limiting portion 34, there is a fear that the unsealing member 20 is deformed and therefore cannot unseal the sealing member 19.

However, as in this embodiment, by providing the limiting portion 34, the deformation of the unsealing member 20 is limited, so that the positional relationship of the inclination peeling shown in (a) of FIG. 8 is maintained and thus the unsealing of the sealing member 19 is stably performed.

FIG. 12 is a sectional view of the process cartridge A in the case where there is no limiting portion 34.

As shown in the figure, in the case where there is a limiting portion 34, after the sealing member is unsealed and then is spaced from the developer bag 16, the sealing member 19 wound about the unsealing member 20 is loosened. For that reason, there is a fear that the sealing member 19 contacts the developer supplying roller 23 to cause image defect. Further, in the case of a constitution in which there is no developer supplying roller 23, there is a fear that the sealing member 19 contacts the developing roller 13 to cause the image defect.

However, as shown in (b) of FIG. 9, by providing the limiting portion 34, the sealing member 19 is, after being unsealed and wound up, limited by the limiting portion 34 so as not to be spaced from the unsealing member 20 by being wound about the unsealing member 20. As a result, it is possible to prevent the image defect caused due to the contact of the sealing member 19 with the developing roller 19 or the developer supplying roller 23.

Further, in the case where there is no limiting portion 34, there is a fear that the developer bag 16 is moved and contacted to the developing roller 13 or the developer supplying roller 23 by gravitation or an impact by mounting and demounting of the process cartridge A.

However, as shown in FIG. 3 or the like, the limiting portion 34 is disposed between the developing roller 13, the developer supplying roller 23 and the developer bag 16. For that reason, it is possible to prevent the developer bag 16 from moving toward and contacting the developing roller 13 or the developer supplying roller 23 by gravitation or the impact by the mounting and demounting of the process cartridge A. As a result, it is possible to prevent the image defect due to the contact of the developer bag 16 with the developing roller 13 or the developer supplying roller 23.

<Another Example of Structure of Limiting Portion>

FIG. 13 is a sectional view of the developing unit 38, showing another example of the structure of the limiting portion 34.

As shown in the figure, depending on a relationship between a length or strength of the unsealing member 20 and a force required for the unsealing of the unsealing member 20, a plurality of limiting portions 34 may also be provided with respect to the rotational axis direction of the unsealing member 20. In this case, compared with the case where only one limiting portion 34 is provided, the limitation of the deformation of the unsealing member 20 is performed more accurately.

Parts (a) and (b) of FIG. 14 are schematic views showing another example of the structure of the limiting portion 34, in which (a) of FIG. 14 is a sectional view of a peripheral portion of the openings 35*a* of the developer accommodating container 26 before the unsealing in this structural example with respect to a develop perpendicular to the rotation shaft of the unsealing member 20, and (b) of FIG. 14 is the schematic view showing a cross section of a plane including the rotation shaft of the unsealing member 20.

As shown in the figure, the limiting portion 34 is provided with a roller member 36 (roller) which is rotatably supported, and otherwise has the same structure as that shown in FIG. 7. The roller member 36 is rotated by rotation of the unsealing member 20 when contacted to the unsealing member 20, thus supporting the unsealing member 20. By employing such a constitution, it is possible to suppress an increase in torque due to friction between the limiting portion 34 and the unsealing member 20.

Parts (a) and (b) of FIG. 15 are schematic views showing another example of the structure of the limiting portion 34, in which (a) of FIG. 15 is a sectional view of a peripheral portion of the openings 35*a* of the developer accommodating container 26 before the unsealing in this structural example with respect to a develop perpendicular to the rotation shaft of the unsealing member 20, and (b) of FIG. 15 is the schematic view showing a cross section of a plane including the rotation shaft of the unsealing member 20.

In the structural example shown in FIG. 14, the single roller member 36 is provided, but in the structural example shown in FIG. 15, two roller members 36 are provided and each of the roller members 36 is constituted so as to contact the unsealing member 20 to rotatably support the unsealing member 20. Other constitutions are the same as those in the structural example shown in FIG. 14.

Thus, the unsealing member 20 is rotatably supported by the two roller members 36, and therefore compared with the case shown in FIG. 14, it is possible to limit the deformation of the unsealing member 20 more stably.

Second Embodiment

<Embodiment in which Limiting Portion and Unsealing Member are Spaced after Unsealing>

Second Embodiment of the present invention will be described.

Parts (a), (b) and (c) of FIG. 16 are sectional views showing a peripheral portion of an opening of a developer bag in Second Embodiment, in which (a) of FIG. 16 shows a state before unsealing, (b) of FIG. 16 shows a state during the unsealing, and (c) of FIG. 16 shows a state after the unsealing. Incidentally, identical or similar constituent elements to those in First Embodiment are represented by the same reference numerals or symbols and will be omitted from redundant description.

In this embodiment, a limiting portion 34*a* and a limited portion 20*d* of the unsealing member 20 are constituted so as to be spaced from each other after unsealing of the sealing member 19. The developer bag 16 and the sealing member 19 have the same constitution as those in First Embodiment, but a positional relationship between the limited portion 20*d* of the unsealing member 20 and the limiting portion 34*d* of the container is different from that in First Embodiment.

As shown in (a) of FIG. 16, a force for winding up the sealing member 19 is not generated in the unsealing member 20, and therefore a spacing L is generated between the limited portion 20*d* of the unsealing member 20 and the limiting portion 34*a*.

Then, during the unsealing, as shown in (b) of FIG. 16, the unsealing member 20 pulls the sealing member 19 in an arrow D direction, and by a reaction force, is pulled in an arrow H direction. For this reason, the unsealing member 20 is slightly deformed with respect to an arrow Q direction, so that the limiting portion 34*a* and the limited portion 20*d* of the unsealing member 20 are in contact with each other and thus the limiting portion 34*a* suppresses further deformation of the unsealing member 20.

Further, after the unsealing, as shown in (c) of FIG. 16, the flexure of the unsealing member 20 by the force required for unsealing the sealing member 19 is eliminated, and therefore the limiting portion 34*a* and the limited portion 20*d* of the unsealing member 20 are spaced from each other.

That is, after the sealing member 19 is unsealed, the limiting portion 34*a* is spaced from the unsealing member 20 and thus does not limit the unsealing member 20. For this reason, during image formation after the unsealing, it is possible to eliminate a torque due to friction between the limiting portion 34*a* and the unsealing member 20, so that it becomes possible to decrease a driving force to be applied to the unsealing member 20.

Third Embodiment

<Embodiment in which Sealing Member is Provided with Slit Through which Limiting Portion can Enter>

Third Embodiment of the present invention will be described.

In this embodiment, a sealing member is provided with a slit through which a limiting portion can enter.

Parts (a) and (b) of FIG. 17 are schematic views showing a peripheral portion of openings 35*a* of a developer accommodating container 26 before unsealing in Third Embodiment, in which (a) of FIG. 17 is sectional view with respect to a direction perpendicular to a rotation shaft of an unsealing member 20 and (b) of FIG. 17 shows a cross section including the rotation shaft of the unsealing member 20. Incidentally, identical or similar constituent elements (portions) to those in First Embodiment are represented by the same reference numerals or symbols and will be omitted from redundant description.

As shown in (a) of FIG. 17, a sealing member 119 is provided with a slit 19*e* through which a limiting portion 34 can enter. The limiting portion enters through the slit 19*e* and rotatably limits the unsealing member 20. The slit 19*e* is provided in the sealing member 119 along an arrow E direction in which the sealing member 119 is to be pulled.

Further, as shown in (b) of FIG. 17, with respect to a rotational axis direction of the unsealing member 20, the slit 19*e* is provided in the neighborhood of the limiting portion 34.

Next, a relationship between the sealing member 119 and the unsealing member 20 during the unsealing will be described.

In this embodiment, a rotational direction of the unsealing member 20 is an arrow R direction. The slit 19 is provided, and therefore the unsealing member 20 can wind up the sealing member 119 without sandwiching the sealing member 119 between the limiting portion 34 and the unsealing member 20.

FIG. 18 is a sectional view of a peripheral portion f the openings 35*a* of the developer accommodating container 26 with respect to the direction perpendicular to the rotation shaft of the unsealing member 20 before the unsealing in the case where the slit 19*e* is not provided.

As shown in the figure, with respect to the arrow R direction as the rotational direction of the unsealing member 20, in the case where there is no slit 19*e*, the sealing member 19 is wound up while being sandwiched between the limiting portion 34 and the unsealing member 20, and therefore compared with the case where there is the slit 19*e*, a rotation torque is increased. However, in this embodiment, the slit 19*e* is provided, and therefore the sealing member 19 can be wound up without being sandwiched between the limiting portion 34 and the unsealing member 20, so that the rotation torque can be suppressed at a low level.

Incidentally, in the case where the rotational direction is the arrow C direction opposite to the arrow R direction as in First Embodiment, the sealing member 19 is not wound up while being sandwiched between the unsealing member 20 and the limiting portion 34, and therefore the winding-up of the sealing member 19 is irrespective of the presence or absence of the slit 19*e*.

In this way, in the case where the slit 19*e* is provided, even when the limiting portion 34 is provided, the rotational direction is selectable between the arrow R direction and the arrow C direction, so that a degree of freedom of design is increased.

Further, when a plurality of limiting portions 34 are provided, correspondingly to the limiting portions, a plurality of slits 19*e* (not shown) may also be provided.

Parts (a) and (b) of FIG. 19 are perspective views each showing the developer bag 16 and the sealing member 119 in the case where the sealing member 119 is provided with a slit, in which (a) of FIG. 19 shows a single sheet of the sealing member 119 provided with the slit 19*e*, and (b) of FIG. 19 shows two sheets of the sealing member 119 provided with the slit 19*f*.

Fourth Embodiment

<Embodiment in which Limiting Portion Also Functions as Fixing Portion>

Fourth Embodiment of the present invention will be described.

In this embodiment, a limiting portion is configured to also function as a fixing portion.

Parts (a), (b) and (c) of FIG. 20 are schematic views showing a peripheral portion of openings 35*a* of a developer accommodating container 26 before unsealing and showing a structure of a limiting portion in Fourth Embodiment, in which (a) of FIG. 20 is sectional view with respect to a direction perpendicular to a rotation shaft of an unsealing member 20 and each of (b) and (c) of FIG. 20 is a perspective view of a boss 18*a* of a second frame 18 and a fixing portion 16*c* of a developer bag 16. Incidentally, identical or similar constituent elements (portions) to those in First Embodiment are represented by the same reference numerals or symbols and will be omitted from redundant description.

The developer bag 16 and the sealing member 19 are the same as those in First Embodiment, but structures of the limiting portion and the boss of the second frame 18 are different from those in First Embodiment.

As shown in (a) of FIG. 20, a boss 18*a* of the second frame 18 is extended to constitute a limiting portion 34*b*. That is, the boss 18*a* is configured to also function as the limiting portion 34*b*.

Further, as shown in (b) of FIG. 20, a boss 18*a* of the second frame 18 constitutes a limiting portion 34*b* by being inserted into a fixing portion 16*d* as a hole of the developer bag 16 to fix the developer bag 16 at a base portion 18*d* thereof by hooking, so that the limiting portion 34*b* as an end of the boss 18*a* limits movement of the unsealing member 20.

Incidentally, a shape of the boss 18*a* may be circular in cross section as shown in (b) of FIG. 20 or rectangular in cross section as shown in (c) of FIG. 20.

In this way, the boss 18*a* also functions as the limiting portion 34*b*, so that there is no need to separately provide the limiting portion 34*b* and the boss 18*a*, and thus it is possible to improve a space efficiency and to increase a degree of freedom of design.

The present invention is applicable to an image forming apparatus such as a printer.

According to the developer accommodating unit of the present invention, the deformation of the unsealing member due to the pulling of the unsealing member by the sealing member is limited by the limiting portion. For this reason, even in the case where strength for peeling off the bonding portion between the sealing member and the accommodating portion is large, the sealing member can be peeled off with reliability, so that the developer can be supplied stably.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 003263/2013 filed Jan. 11, 2013, which is hereby incorporated by reference.

What is claimed is:

1. A developer accommodating container comprising:

a flexible container provided with an opening for permitting discharge of a developer therein;

a sealing member mounted for sealing the opening;

an unsealing member for winding up said sealing member to expose the opening;

a frame for accommodating said unsealing member and said flexible container inside of said frame; and a limiting portion for limiting deformation of said unsealing member with respect to a direction of a force applied from said sealing member to said unsealing member when said unsealing member winds up said sealing member wherein at least a part of said limiting portion also functions as a fixing portion for fixing said flexible container to said frame.

2. A developer accommodating unit according to claim 1, wherein said limiting portion limits the deformation of said unsealing member with respect to a direction crossing a rotation shaft of said unsealing member.

3. A developer accommodating unit according to claim 2, wherein said limiting portion is provided on said frame so as at limit the deformation of said unsealing member at least at one position inside ends of said unsealing member with respect to a direction of the rotation shaft of said unsealing member.

4. A developer accommodating unit according to claim 2, wherein said unsealing member is contactable with the developer.

5. A developer accommodating unit according to claim 1, wherein said unsealing member is rotatably supported at end portions thereof with respect to the direction of a rotation shaft of said unsealing member.

6. A developer accommodating unit according to claim 1, wherein said limiting portion is a projected portion elongated in a direction from said frame toward said unsealing member.

7. A developer accommodating unit according to claim 1, wherein a predetermined gap is provided between said limiting portion and said unsealing member, and wherein said unsealing member is contacted to said limiting portion by receiving the force from said sealing member when said unsealing member winds up said sealing member thereby to limit further deformation of said unsealing member.

8. A developer accommodating unit according to claim 1, wherein said sealing member is provided with a slit for permitting entrance of said limiting portion when said sealing member is wound up by said unsealing member.

9. A developer accommodating unit according to claim 1, wherein said limiting portion is provided with at least one roller rotated in contact with said unsealing member by rotation of said unsealing member when said limiting portion limits the deformation of said unsealing member.

10. A process cartridge, detachably mountable to an image forming apparatus, for executing at least a part of an image forming process of the image forming apparatus when said process cartridge is mounted in the image forming apparatus, said process cartridge comprising:

a developer accommodating unit according to claim 1; and an image bearing member for bearing a developer image formed by being supplied with the developer discharged from said developer accommodating unit.

11. An image forming apparatus for forming an image on a recording material comprising:

a process cartridge according to claim 10; and transfer means for transferring the developer image from said image bearing member onto a recording material.

12. A developer accommodating unit according to claim 1, wherein said limiting portion limits deformation of a center of a rotation shaft of said unsealing member.

13. A developing device comprising:

a developer accommodating unit according to claim 1; and a developing roller carrying the developer.

14. A developer accommodating container comprising:

a container provided with an opening for permitting discharge of developer therein;

a sealing member for sealing the opening;

an unsealing member for winding up said sealing member to expose the opening, said unsealing member being contactable with the developer; and a limiting portion for limiting deformation of said unsealing member with respect to a direction of a force applied from said sealing member to said unsealing member when said unsealing member winds up said sealing member, wherein said container has a length in a longitudinal direction that is longer than a length of said cartridge in a direction perpendicular to the longitudinal direction, and wherein said limiting portion is located in a center of said container with respect to the longitudinal direction of said container.

15. A developer accommodating unit according to claim 14, wherein at least a part of said limiting portion also functions as a fixing portion for fixing said flexible container to a frame.

16. A developer accommodating unit according to claim 14, wherein said limiting portion limits the deformation of a center of a rotation shaft of said unsealing member.

17. A developing device comprising:

a developer accommodating unit according to claim 14; and a developing roller carrying the developer.

18. A developer accommodating container comprising:

a container provided with an opening for permitting discharge of developer therein;

a sealing member for sealing the opening;

an unsealing member for winding up said sealing member to expose the opening, said unsealing member being contactable with the developer; and a limiting portion for limiting deformation of said unsealing member with respect to a direction of a force applied from said sealing member to said unsealing member when said unsealing member winds up said sealing member, wherein said container has a length in a longitudinal direction that is longer than a length of said cartridge in a direction perpendicular to the longitudinal direction, and wherein said limiting portion is located at other than both end sides of said container with respect to the longitudinal direction of said container.

* * * * *